United States Patent [19]

Ito

[11] Patent Number: 4,752,809

[45] Date of Patent: Jun. 21, 1988

[54] COPYING MACHINE FOR SELECTIVE REPRODUCTION OF IMAGES

[75] Inventor: Masazumi Ito, Toyohashi, Japan

[73] Assignee: Minolta Camera Kabushiki Kaisha, Osaka, Japan

[21] Appl. No.: 793,587

[22] Filed: Oct. 31, 1985

[30] Foreign Application Priority Data

| | | | |
|---|---|---|---|
| Oct. 31, 1984 | [JP] | Japan | 59-230678 |
| Jun. 20, 1985 | [JP] | Japan | 60-135806 |
| Jun. 20, 1985 | [JP] | Japan | 60-135807 |

[51] Int. Cl.[4] ..... G03G 15/04

[52] U.S. Cl. ..... 355/14 R; 355/7

[58] Field of Search ..... 355/14 R, 3 R, 7, 67, 355/75

[56] References Cited

U.S. PATENT DOCUMENTS

| | | | |
|---|---|---|---|
| 4,017,173 | 4/1977 | Komori et al. | 355/8 |
| 4,068,948 | 1/1978 | Ritzerfeld | 355/75 |
| 4,256,400 | 3/1981 | Komori et al. | 355/14 SH |
| 4,582,417 | 4/1986 | Yagasaki et al. | 355/7 |

FOREIGN PATENT DOCUMENTS

| | | |
|---|---|---|
| 57-41671 | 3/1982 | Japan . |
| 57-56859 | 4/1982 | Japan . |
| 58-43480 | 3/1983 | Japan . |

*Primary Examiner*—R. L. Moses

*Attorney, Agent, or Firm*—Price, Gess & Ubell

[57] ABSTRACT

A copying apparatus capable of making a copy of selected area of a document achieves various procedure of partly copying in combination with an automatic document feeder capable of inverting the document, an area selecting mechanism with a block indication, an automatically magnification selecting mechanism, an automatically paper-size selecting mechanism, a duplex mechanism and a copy paper re-feeding mechanism.

33 Claims, 47 Drawing Sheets

1
#2216
select key 370 ON edge ?
NO
YES
#2217
L11 ON ?
NO
YES
#2218
L11 OFF
#2219
L12 ON
#2220
L12 ON ?
NO
YES
#2221
L12 OFF
#2222
L13 ON
#2223
L13 ON?
NO
YES
#2224
edit mode ?
YES
NO
#2225
L13 OFF
2226
L11 ON
#2227
L13 OFF
2228
L14 ON
#2229
L14 ON ?
NO
YES
#2230
L14 OFF
#2231
L15 ON
#2232
L15 OFF
#2233
L11 ON
#2234
CPU 1 ← mode
return

COPYING MACHINE FOR SELECTIVE REPRODUCTION OF IMAGES

BACKGROUND OF THE INVENTION

The present invention relates to an electrophotographic copying machine, and more particularly to an electrophotographic copying machine for copying optional portions of documents on optional portions of copy paper.

Usually copying machines copy the entire portion of an original as it is. However, there arises a need to copy only a portion of the original. In such a case, the portion of the original to be copied is usually cut off for copying, but this procedure is very inconvenient.

To eliminate this inconvenience, various partial copying methods have been proposed. U.S. Pat. No. 4,068,948, for example, discloses a method wherein the unnecessary portion of the original is covered with two movable masking members before copying. In another method of partial copying, the charges on the photosensitive member are erased from the portion thereof corresponding to the unnecessary portion of the original. The charges on the photosensitive member are erased by an illuminating device which comprises an array of lamps arranged between the charger and the developing unit and opposed to the photosensitive member. This method is disclosed, for example, in Unexamined Japanese Patent Publication No. SHO No. 57-41671.

What matters in a partial copying operation is how to specify the portion to be copied. According to Unexamined Japanese Patent Publication No. SHO 57-56859, the portion of the orginal to be copied is surrounded by a marker of a color insensitive to the photosensitive member, and the area marked off is detected by a color sensor for controlling a charge erasing lamp array. However, this method has the objection that the original is colored with the marker. U.S. Pat. No. 4,256,400 discloses a method wherein cursors provided along two edges of a document support glass plate are used for specifying the portion to be copied. This method has the drawback that it is difficult to specify the desired portion since the original is placed on the glass plate face down. Unexamined Japanese Patent Publication No. SHO 58-43480 discloses a method which employs a document feeder (hereinafter referred to as "DF") having a transparent plate ruled into squares on its upper surface and in which the transparent plate is placed over the original to read the coordinates of the portion to be copied using the squares, and the coordinates are entered with numerical keys. The coordinate input system requires the cumbersome procedure of manipulating many keys and involves extreme difficulties in specifying areas other than simple square to rectangular areas.

In conducting partial copying operations, it is desired to locate the partial copying area in a desired position on the copy paper. The above-mentioned Publication No. SHO 58-43480 includes the proposal of shifting the partial copying area on copy paper in the direction of transport thereof by adjusting the copy paper register timing and of shifting the area in a direction perpendicular to the transport direction by causing the DF to feed the original in the perpendicular direction to an adjusted position on the support glass plate. Nevertheless, in view of the relationship between the paper discharge tray of DF and the operation panel of the copying machine, this proposal is in conflict with the development of DF into an auto document feeder (hereinafter referred to as "ADF") for automatically copying a plurality of originals when the ADF is to be realized without making the overall apparatus large-sized.

Further in partial copying, it is cumbersome to select an optimum copy size or magnification for the local copying area. It is also desired to effect such selection automatically.

Another demand as to partial copying is directed to the processing of a plurality of partial copying areas. For example, when an original has two portions which are to be copied separately on two sheets of copy paper or on the front side and rear side of a single sheet of copy paper, the two portions conventionally need to be handled separately. Further for example when a single copy is to be made from two originals each having one portion to be copied, it has been necessary to process the two portions separately.

SUMMARY OF THE INVENTION

Accordingly, the main object of the present invention is to provide a copying machine having an improved partial copying function.

Another object of the present invention is to provide a copying machine having a partial copying function and easy to use.

Another object of the present invention is to provide a copying machine wherein the area to be copied partially can be specified easily.

Another object of the present invention is to provide a copying machine wherein the area to be copied partially is shiftable on copy paper by means of simple construction.

Another object of the present invention is to provide a copying machine which is adapted to automatically select a copy paper size or magnification suited to the specified area to be partially copied.

Another object of the present invention is to provide a copying machine capable of automatically processing a plurality of areas to be copied partially.

The apparatus for fulfilling the above objects consists essentially of an eraser array comprising a plurality of minute illuminating elements and arranged between a charger and a developing unit in opposed relation to a photosensitive drum, the illuminating elements being individually controllable for the emission of light to form partial images. The apparatus is in combination with the following mechanisms.

Document Edition Mechanism

This mechanism specifies the portion of an original to be copied and erases the area other than the specified area for copying operation and is termed also a partial copying mechanism. The mechanism includes means for specifying the desired area and means for erasing electrostatic latent images from the area other than the specified area. The area specifying means includes a transparent plate having checkered blocks printed thereon for covering the original for specifying the blocks over the required portion. The erasing means includes a plurality of light emitting elements arranged at a latent image forming station and opposed to the photosensitive drum. The light emitting elements are selectively caused to emit light to erase charges from the unnecessary portion.

Copy Edition Mechanism

This mechanism copies the specified area of the original as shifted on copy paper. Copy edition is effected in the direction of feed of copy paper (hereinafter referred to as "feed direction") and in a direction perpendicular to the feed direction (hereinafter referred to as "perpendicular direction") by different means. More specifically, the desired area is shifted in the feed direction by feeding copy paper earlier or later than the copy image on the photosensitive drum through the on-off control of a timing roller. The area is shifted in the perpendicular direction by feeding the copy paper manually and transporting the paper as shifted in the perpendicular direction relative to the copy image on the drum by shifting a manual paper feed table in the perpendicular direction. While the embodiment includes the above means in combination, the perpendicular shift can alternatively be realized by shifting the original itself in the perpendicular direction, or by shifting the projection lens in the perpendicular direction to project an image on the drum at an altered position.

Auto Document Feeder

By this feeder, the original is automatically fed to the document support surface and automatically discharged on completion of copying. When the original is double-faced, the original is further fed as turned upside down for copying the second surface. The auto document feeder, which is so called when it is an assembly separate from the copying machine, is also separate from the copying machine according to the embodiment of the invention. Although the construction of ADF itself is known, the feeder is so controlled according to the invention that the original is set in position face up, reversed within ADF and positioned on the document support surface, to simplify specification of the desired area of the original for automatic edition. This mode of control differs from the conventional control mode.

Double-Face and Composite Copying Mechanism

By this mechanism, copy paper bearing a copy image thereon is returned to the path of feed of paper, as reversed or as it is. The mechanism has a circulation path for returning the copy paper bearing a copy image on its one surface from downstream of a fixing unit to a paper feeder portion, a reverse portion for reversing the copy paper to position its leading end as the rear end and use the second surface for copying, a first change-over portion for selecting a paper discharge tray or the circulation path for further transport of the paper, and a second change-over portion for selecting circulation of the paper through the reverse portion or circulation not through the reverse portion.

Automatic Edition Magnification Selection Mechanism

For automatic magnification setting, this mechanism calculates an optimum magnification from the size of a specified area of the original and the selected paper size so as to accommodate the specified area on copy paper. A copying machine adapted to automatically calculate a magnification from the size of an original and the paper size for setting has been proposed by the present applicant in U.S. Pat. No. 4,575,227 issued on Mar. 11, 1986, while in the case of the present invention wherein the specified areas are not approximately constant in shape and vertical-to-horizontal ratio unlike the size of originals, the vertical magnification and the horizontal magnification are individually calculated, and the smaller of the two is selected for the image of the specified area to be invariably accommodated on copy paper.

Automatic Edition Paper Selection Mechanism

According to the size of the specified area of the original and the selected magnification, this mechanism searches for a paper size sufficient to accommodate the specified area and automatically selects the paper feed portion accommodating paper of suitable size, if any.

With the combination of the above mechanisms or components, the copying machine embodying the present invention is adapted for three kinds of edition which are called simple edition, composite edition and divided edition for the sake of convenience, in addition to the usual copying operation.

"Simple edition" refers to copying of the image of a portion on a desired portion of a single sheet of copy paper.

"Composite edition" refers to copying of the images of two portions on a sheet of copy paper, as positioned optionally on the paper and relative to each other.

"Divided edition" means copying of the images of two portions of a single original separately on two sheets of copy paper or on the front and rear surfaces of a single sheet of copy paper, at desired positions on the paper.

The size of a portion of the original is variable as desired according to the magnification setting, while the size of copy paper to be used is of course selectable.

When the image of the portion specified for simple edition, as well as for divided edition, needs to merely be accommodated on paper, use of the automatic edition magnification selection mechanism or use of this mechanism in combination with the automatic edition paper selection mechanism makes it easy to accommodate the image approximately over the entire area of the paper. If the desired-magnification and paper size are to be selected with reference to a manual, the user must calculate the magnification from the size of image of the portion and the paper size, or the size of paper usable from the size of the image and the magnification. Whereas this procedure is very cumbersome, such calculation can be performed automatically by the combination of the above mechanisms, to provide a great convenience.

Because the images of two portions are reproduced in a composite or divided form in composite edition and divided edition, the apparatus has two memory means for specifying these image areas individually, such that data as to the two fragmentary images is stored in the memory means before edition copying.

These and other objects, advantages and features of the invention will become apparent from the following description thereof taken in conjunction with the accompanying drawings which illustrate a specific embodiments of the invention.

DESCRIPTION OF THE PREFERRED EMBODIMENTS

Figure 1:
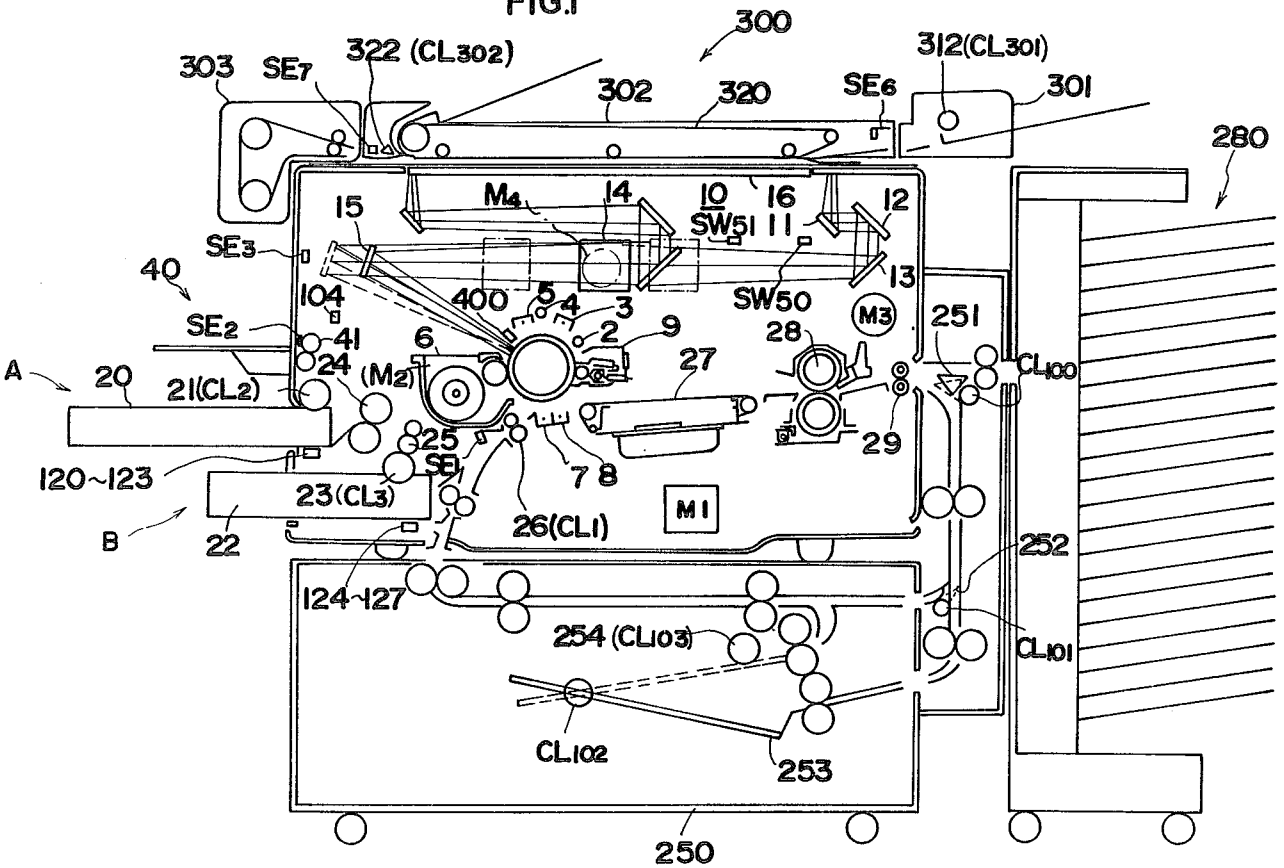
FIG. 1 is a view in cross section showing an electrophotographic copying machine embodying the present invention.

In the following description, like parts are designated by like reference numerals throughout the several drawings.

Embodiments of the present invention will be described below with reference to the drawings.

FIG. 1 shows a copying machine embodying the invention. A photosensitive drum 1, drivingly rotatable counterclockwise, is disposed approximately in the center of the machine main body. Arranged around the drum 1 are a main eraser lamp 2, subsensitizing charger 3, suberaser lamp 4, main sensitizing charger 5, inter-image eraser lamp 400, developing unit 6, transfer charger 7, copy paper separating charger 8 and blade cleaner 9. The drum 1, having a photosensitive surface layer, is sensitized when passing by the eraser lamps 2, 4 and the sensitizing chargers 3, 5 and then exposed to an optical image from an optical system 10.

The optical system 10 for scanning images of originals is provided below a document support glass plate 16 and comprises unillustrated light source, movable mirrors 11, 12, 13, a lens 14 and a mirror 15. While the drum 1 is driven at a peripheral velocity of v (constant irrespective of magnifications), the light source and the movable mirror 11 travel leftward at a velocity of v/m (where m is a copying magnification). The movable mirrors 12, 13 travel leftward at a velocity of v/2m. These movable optical components are driven by a d.c. motor M3. When giving an altered magnification, the lens 14 is moved on the optical path, and the mirror 15 is shifted and pivotally moved. Indicated at SW50 is a switch for determining the home position of the scanning system, and at SW51 a switch for giving register timing to the scanning system.

Provided at the left side of the main body are A and B paper feeders 20, 22 having paper feed rollers 21, 23, respectively. The path of transport of copy paper is provided with pairs of rollers 24, 25, pair of timing rollers 26, conveyor belt 27, fixing unit 28 and discharge rollers 29.

The A paper feeder has size sensor switches 120 to 123, while the B paper feeder has size sensor switches 124 to 127. Paper sizes are expressed in codes afforded by combinations of binary outputs from each switch group.

A timing roller front sensor SE1 for controlling the pair of timing rollers 26 is disposed upstream of the pair 26 with respect to the transport of paper.

A manual paper feeder 40 is disposed above the A paper feeder. Manually fed paper is passed between a pair of rollers 41 and led into the path of transport of paper for the A paper feeder at the pair of rollers 24. A sensor SE2 for detecting the manually fed paper is provided upstream of the pair of rollers 41. The manual paper feeder 40 is openable relative to the main body. A sensor SE3 mounted on a side wall of the main body detects the opening or closing of the manual feeder.

Figure 2:
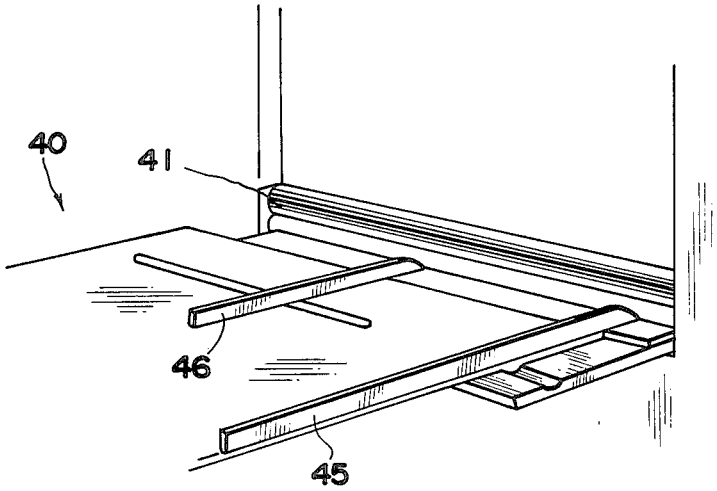
FIG. 2 is a fragmentary perspective view of a manual paper feeder.
Figure 3B:
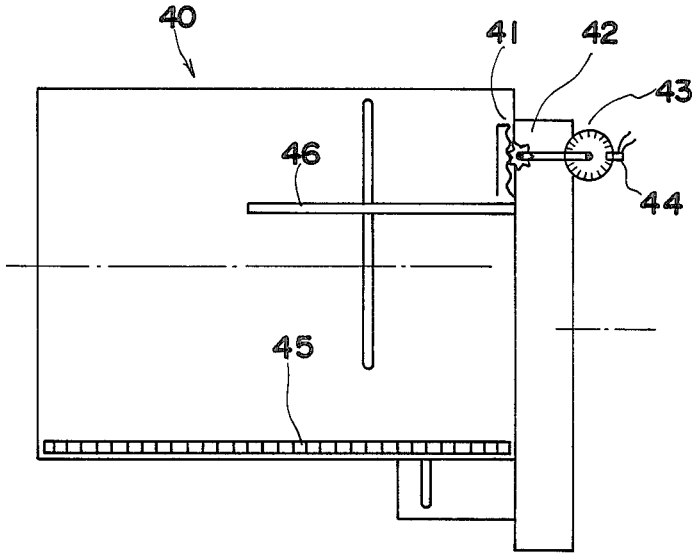
FIGS. 3A and 3B are a plan view of the same.
Figure 3A:
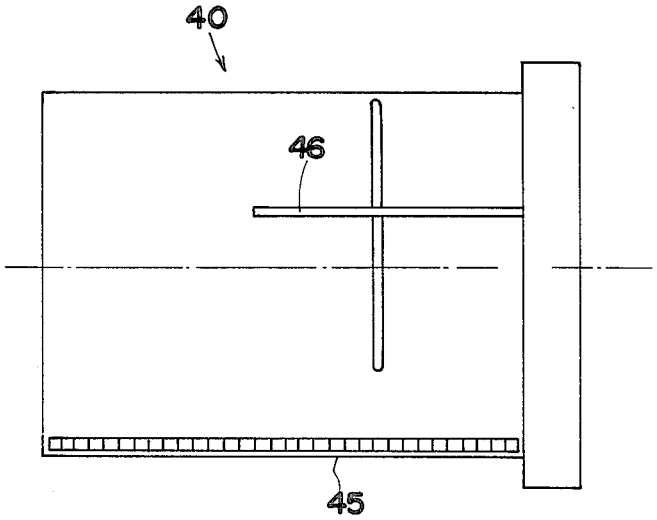

As seen in FIGS. 2 and 3, the manual paper feeder 40 is shiftable perpendicular to the direction of feed of paper. The amount of shift from a reference position (FIG. 3A) is detectable by a sensor 44 from the amount of rotation of a pulse disk 43 which is rotated via a rack 41 and a pinion 44 (FIG. 3B). A fixed guide plate 45 and a movable guide plate 46 are provided on the upper surface of the feeder 40 for limiting the position of paper to be fed manually.

A double face unit 250 is disposed below and at the other side of the main body for double-face and composite copying. The double face unit 250 includes a first change-over guide 251 movable by a clutch CL100 and a second change-over guide 252 movable by a clutch CL101. These guides are moved to select a path of travel of copy paper for usual single-face copying, double-face copying or composite copying. For double-face copying, the copy paper having a copy image formed on one surface is temporarily held on an intermediate tray 253, which is pivotally moved to the broken-line position in FIG. 1 by a clutch CL102 in response to a rear surface copying start signal, whereupon the paper is fed into the copying machine by a re-feed roller 254, whereby the paper is turned upside down with its leading end positioned as the rear end.

For composite copying, the paper is sent directly into the machine main body by the clutch CL101 without being led onto the intermediate tray 253, and another copy image is formed on the same surface as the previous image.

On completion of a copying operation, the copy paper is sent to a sorter 280.

An auto document feeder (ADF) 300 will be described with reference to FIGS. 1 and 4. The ADF 300 comprises a document feed assembly, a transport assembly 302 and a reverse assembly 303. The document feed assembly has a tray 301, an area plate 311 and feed roller 312. The area plate 311 is made of a transparent material and has printed on its upper surface a checkered pattern and area numbers. The transport assembly 302, which is positioned above the document support glass plate 16, has a document conveyor belt 320, a discharge path for delivering documents onto a discharge tray 321, and a change-over guide 322 for directing the document or original toward the discharge path or the reverse assembly 303. The belt 320 transports the document to a specified position on the glass plate 16 and, on completion of copying, transports the document toward the guide 322. A document sensor SE6 is provided between the feed assembly 301 and the conveyor belt 320, and another document sensor SE7 between the guide 322 and the reverse assembly 303. These sensors produce signals for controlling the transport of documents. The reverse assembly 303 for returning the document to the feed assembly 302 is used for reversing double-face documents and edition copying of such documents.

To assure the user of convenience, the desired area of an original for edition copying is specified with face up, and the original is fed to the ADF in this state, so that the original set with its face up is first sent to the reverse assembly 302, where it is reversed and then positioned in place on the glass plate 16.

Figure 4:
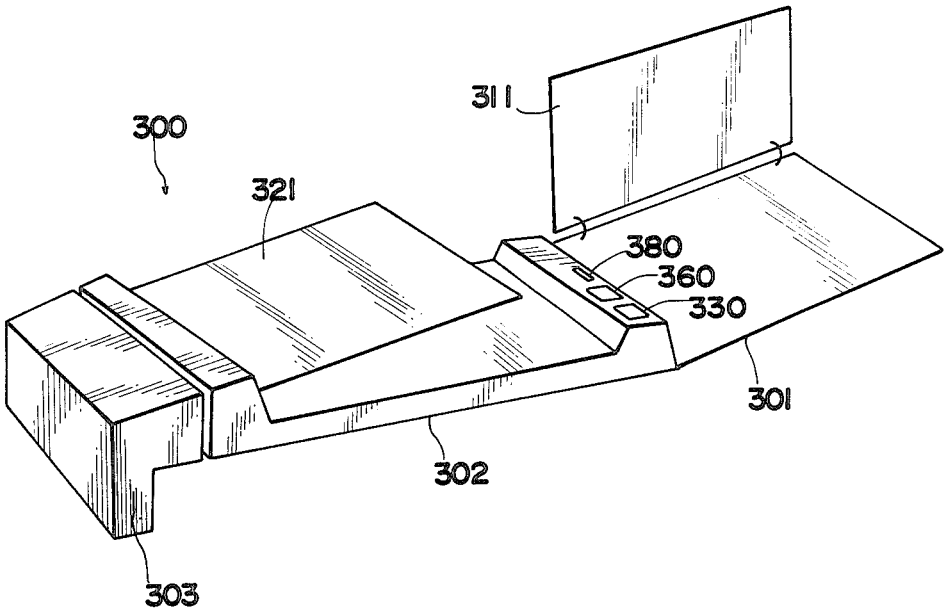
FIG. 4 is a perspective view showing an ADF.

As shown in FIG. 4, the ADF has on its upper surface a first operation panel 330, a second operation panel 360 and a display 380 for showing which side of the original should be up (down) when it is set.

Figure 5:
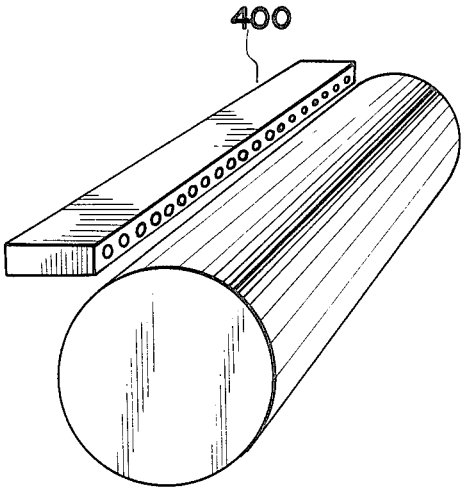
FIG. 5 is a perspective view showing an interimage eraser.

FIG. 5 shows an inter-image eraser 400 disposed downstream from the charger 5 and opposed to the drum 1. The eraser 400 comprises an array of many light-emitting elements which can be selectively caused to emit light for erasing the electrostatic latent image on the drum 1 from the area other than the specified area.

Figure 6:
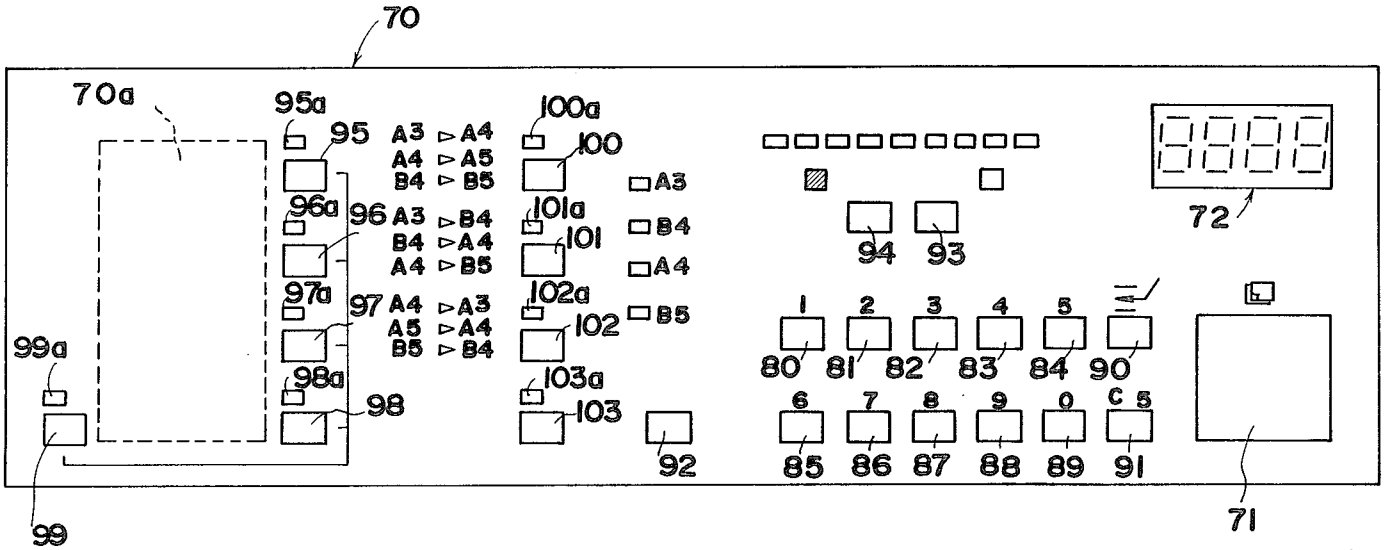
FIG. 6 is a plan view showing the operation panel of the copying machine.

FIG. 6 shows operation keys as arranged on the operation panel of the copying machine. The operation panel 70 has a print key 71 for starting a copying operation, a numerical value display 72 capable of showing four-digit numerical values, ten keys 80 to 89 corresponding to the numerical values of 1, 2, . . . , 9 and 0, respectively, an interrupt key 90 for specifying interrupt copying, a clear/stop key 91, a paper selection key 92 for specifying copy paper provided in stages according to the size, up and down keys 93, 94 for varying copy image density stepwise and specifying the desired density, and keys 95 to 103 for setting magnifications.

The numerical value display 72 comprises seven-segment LED's *72a* to *72d* for four digit positions. The magnification is settable as desired over the range of 0.647× to 1.414× and is variable by 0.001 at a time. The magnification setting arrangement is described in detail in the aforementioned application Ser. No. 561,571.

Figure 7A:
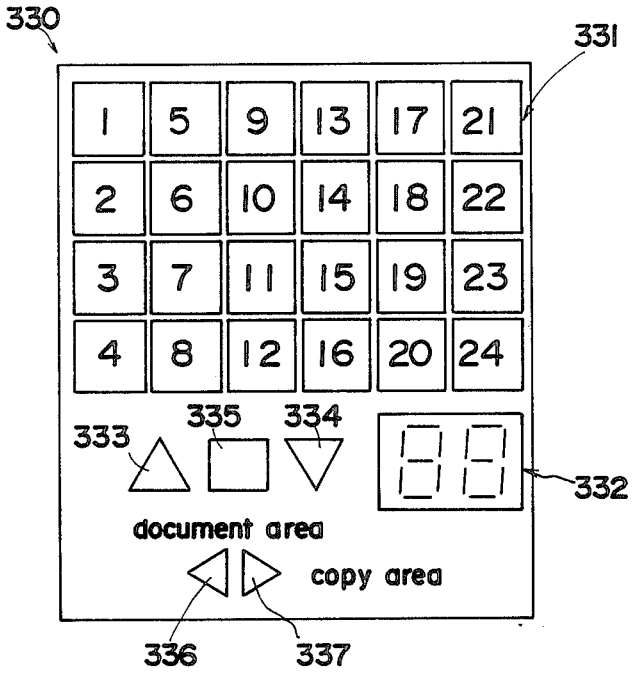
FIG. 7A is a plan view showing a first operation panel of the ADF.
Figure 7B:
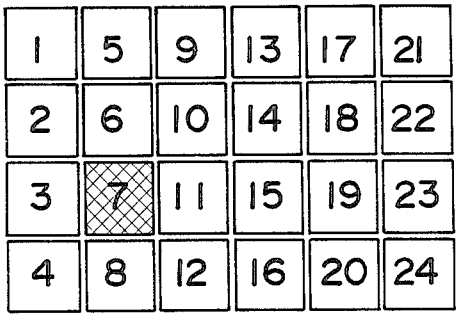
FIGS. 7B to 7F are plan views showing a graphic display on the first operation panel.
Figure 7C:
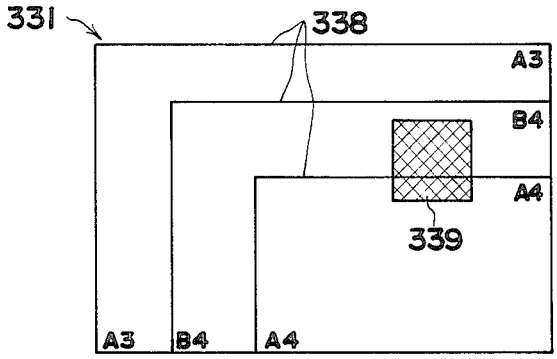
Figure 7D:
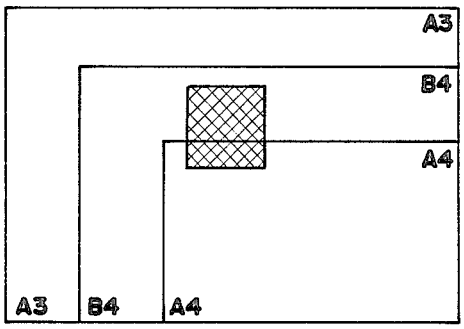
Figure 7E:
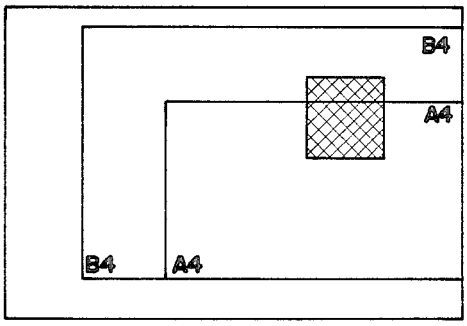
Figure 7F:
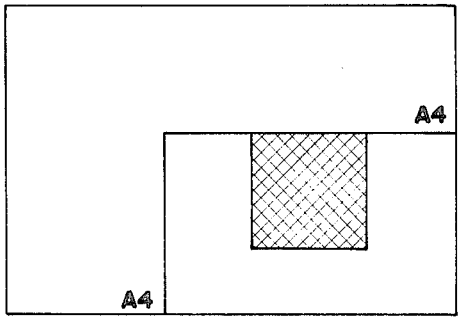
Figure 8:
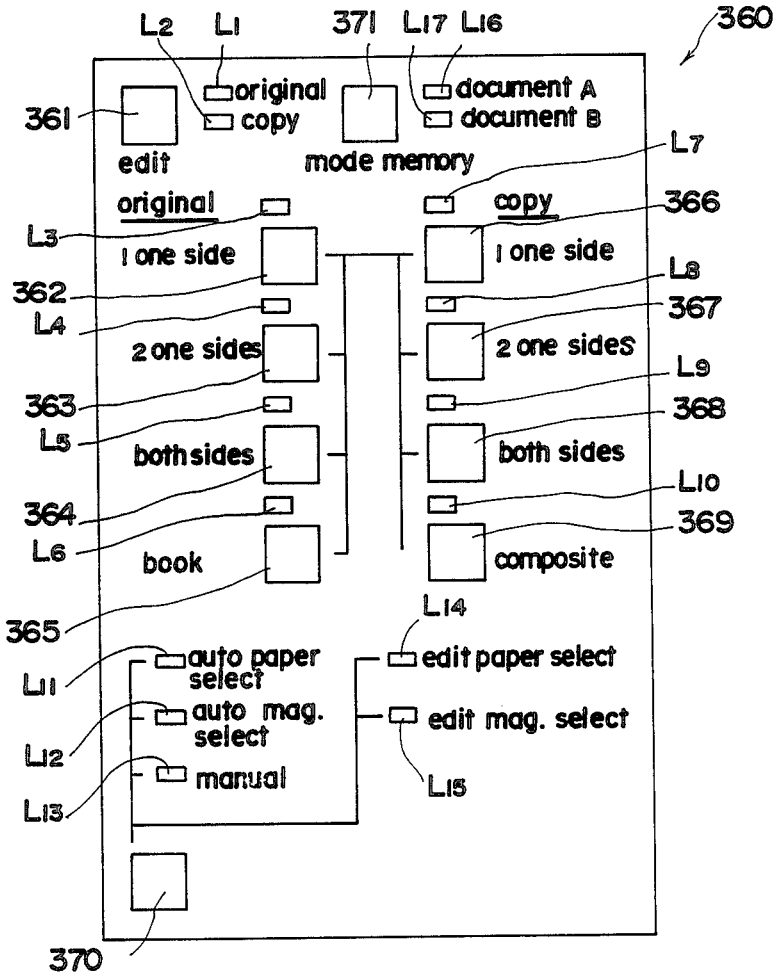
FIG. 8 is a plan view showing a second operation panel of the ADF.
Figure 9:
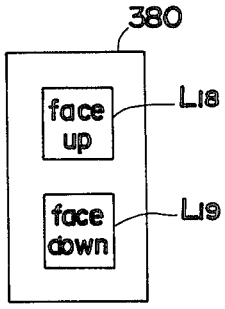
FIG. 9 is a plan view showing a document setting direction display on the ADF.

FIGS. 7, 8 and 9 show the first operation panel 330, the second operation panel 360 and the display 380 on the ADF.

The first operation panel 330 shown in FIG. 7A is used for specifying areas for editing originals and copies. The panel has a graphic display 331 for showing the specified area, a number display 332 for showing an original area number, an up key 333 and a down key 334 for changing the original area number, a setting key 335 for setting the specified area number, and shift keys 336, 337 for specifying the copy area.

The graphic display 331 comprises minute LCD's which are arranged in the form of a matrix and which are selectively turned on or off to give a graphic display. FIG. 7A shows an initial display for specifying an area of the original. Squares or a checkered pattern and area numbers corresponding to those on the area plate 311 are on display. When an area of the original is specified as will be described later, the specified area is shown as seen in FIG. 7B. On the other hand, when specifying a copy area, the display changes as shown in FIG. 7C. FIG. 7C shows frame lines 338 representing paper sizes and also shows where the fragmentary image 339 in the specified area of the original will be positioned on the paper if it is copied as it is. In the drawing, the horizontal direction corresponds to the direction of transport of paper (feed direction). The fragmentary image on display is shiftable horizontally (in the feed direction) by manipulating the shift keys 336, 337. FIG. 7D shows the fragmentary image as shifted leftward from the position in FIG. 7C by depressing the shift key 336. The amount of shift is stored in the manner to be described later to alter the paper transport timing and thereby shift the image to the specified position on copy paper.

While the fragmentary image is shifted in the feed direction as stated above, the image is shiftable in the perpendicular direction using the manual feeder 40 shown in FIGS. 2 and 3, i.e., by shifting the manual feeder 40 in the perpendicular direction. The amount of shift is detected by the pulse disk 43 and the sensor 44 to shift paper size frame lines of the display 331 as seen in FIG. 7E. This enables the user to shift the the manual feeder 40 to the desired position with reference to the relation between the fragmentary image and the frame lines shown on the graphic display 331.

In the case of manual feed, the display 331 shows the frame lines for all sizes of paper which is feedable when the table is in the shifted position. When a cassette is used for feeding paper, the size of paper to be used is known, so that the frame line for the selected paper size only is shown as seen in FIG. 7F.

The second operation panel 360 shown in FIG. 8 has groups of keys and display or pilot lamps for selecting various modes and storing modes of edition copying afforded by combinations of different modes. With reference to the drawing, a key 361 at the left upper corner of the panel is an edition selection key. A lamp L1 at one side of the key and comprising an LED represents a document (original) edition mode when turned on. A lamp L2 represents a copy edition mode. One of these modes is selected by successively depressing the edition selection key 361. Both the lamps, when off, represent the usual copying mode.

The keys and lamps in four horizontal rows and two vertical rows in the center of the panel 360 are used for selecting the combination of a particular kind of original and a particular kind of copy. The keys in the left vertical row are used for specifying the kind of original and include, as arranged downward, key 362 for one single-faced original, key 363 for two single-faced original, key 364 for a double-faced original and key 365 for a book original. Lamps L3, L4, L5 and L6 above the keys are-turned on when the corresponding key is depressed. Similarly, the keys in the right vertical row are provided for specifying the kind of copy and include, as arranged downward, key 366 for one single-faced copy, key 367 for two single-faced copy, key 368 for double-faced copy and key 369 for composite copy. Lamps L7 to L10 are provided for the keys.

A mode selection key 370 is disposed at the left lower corner of the panel. When successively depressed, the key 370 selectively changes automatic paper selection mode represented by a lamp L11, automatic magnification selection mode by a lamp L12, manual mode by a lamp L13, edition paper selection mode by a lamp L14 and edition magnification selection mode by a lamp L15 one after another.

A key 371 in the right upper portion of the panel 360 is a mode memory key. This key is used for storing in a memory up to two kinds of edition modes determined by the section of edition, selection of a particular combination of original and copy, and mode selection in combination. Two lamps L16 and L17 are provided beside the key 371 for representing the two kinds of edition modes. When the edition selection key 361 is depressed to select original edition, the upper lamp L16 for a first original (A original) goes on first. When the mode memory key 371 is depressed on completion of edition mode setting, the set mode is stored in the memory. Subsequently, the lamp L16 is turned off and the lamp L17 is turned on. The system is now in condition for accepting setting of edition mode for a second original (B original).

FIG. 9 shows the display 380. In the edition mode, an indicator L18 goes on to show that the original is to be set face up. In the usual mode, an indicator L19 is on, showing that the original is to be set face down. This indicates that in the edition mode in which an area of the original is specified with the original positioned face up, the original can be fed as it is after the area specification. On the other hand, although the original is settable face up also in the usual copying mode, all the originals to be copied must then be reversed by the reverse assembly 303. This results in the drawback of necessitating a longer copying time and causing damage to the originals. The indicators L18 and L19 are provided to avoid the drawback.

Figure 10:
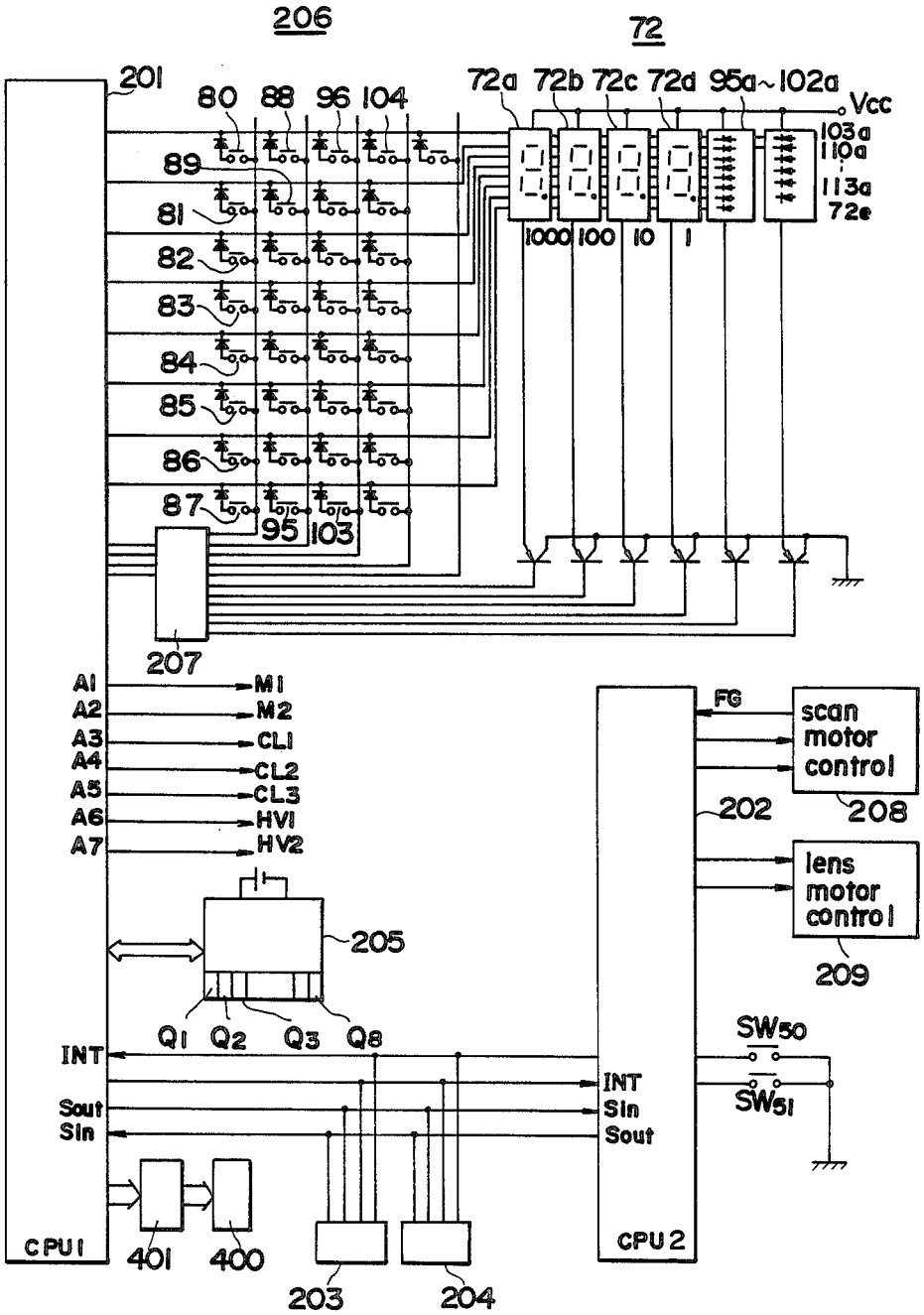
FIG. 10 is a block diagram showing the construction of a control system for the copying machine.
Figure 11:
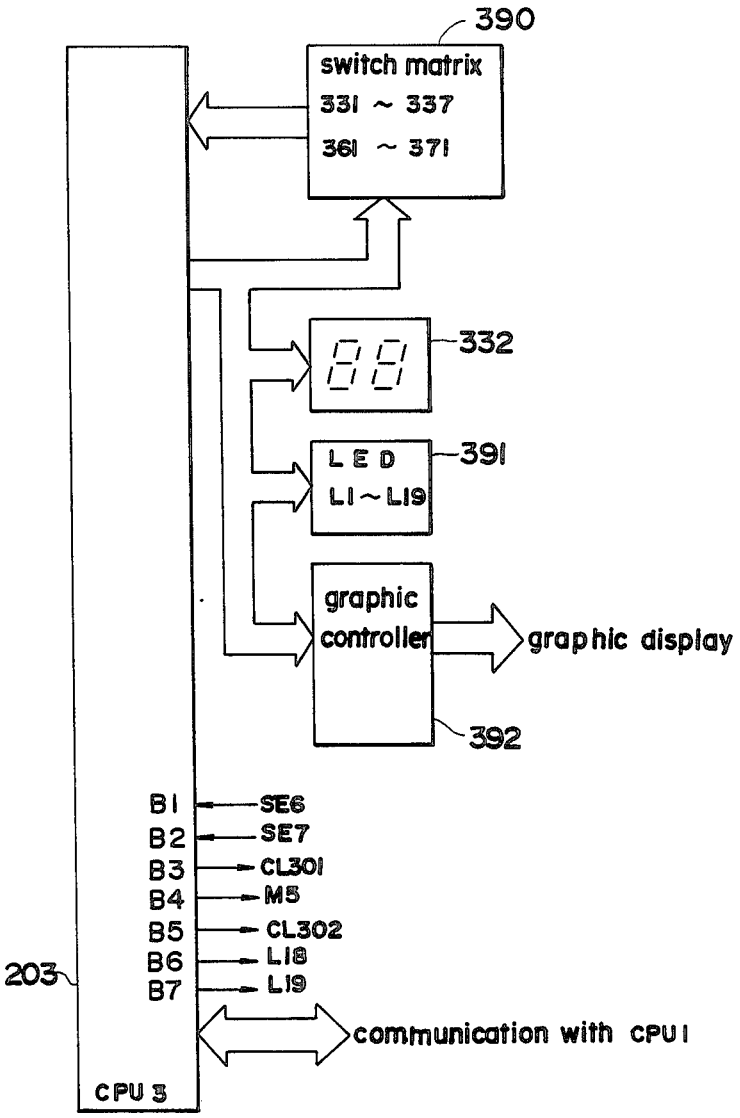
FIG. 11 is a block diagram showing the construction of a control system for the ADF.
Figure 12:
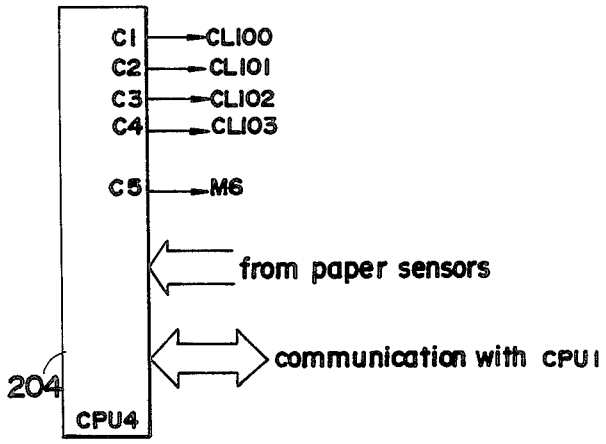
FIG. 12 is a block diagram showing the construction of a control system for a composite unit.

FIGS. 10, 11 and 12 show a control circuit useful for the copying machine of the invention. A first CPU 201 is connected via an interrupt terminal INT and data input and output terminals Sin, Sout to a second CPU 202 (FIG. 10), third CPU 203 (FIG. 11) and fourth CPU (FIG. 12).

The first CPU 201 feeds to an inter-image eraser controller 401 a signal for controlling the inter-image eraser 400. Indicated at 205 is a battery-backed-up RAM, at 206 a switch matrix and at 207 a decoder. Output terminals A1 to A7 are connected to drive switching transistors (not shown) for the main motor M1, developing motor M2, timing roller clutch CL1, upper paper feeder clutch CL2, lower paper feeder clutch CL3, charger 5 and transfer charger 7, respectively.

Various items of data for controlling a copying operation are written in the RAM 205 or stored therein as transferred from a ROM in the CPU. The RAM 205 has memories Q1 to Q8 for storing magnification data in corresponding relation to the magnification selection keys 95 to 98 and 100 to 103.

The second CPU 202 controls the optical system. Indicated at 208 is a drive circuit for the d.c. motor M3 for the scanning optical system, and at 209 a drive circuit for a stepping motor M4 for driving the lens. The switches SW50 and SW51 are arranged in the path of scanning by the optical system and are actuated by the optical system.

The third CPU 203 shown in FIG. 11 controls the ADF. The CPU is connected to switch matrices 390 for the first and second operation panels, group 391 of LED lamps on the second operation panel, a graphic controller 392 for controlling the graphic display 331, and an area number display 332. The third CPU 203 has input terminals B1, B2 for receiving input signals from the document sensors SE6,SE7, and output terminals B3 to B7 for delivering output signals to a document feed clutch CL301, a motor M5 for the ADF, a dicharge-reverse change-over clutch CL302 and the indicators L18, L19 of the display 380.

The fourth CPU 204 shown in FIG. 12 controls the double face unit and has output terminals C1 to C5 for delivering control signals to the clutch CL100, clutch CL101, paper re-feed clutch CL103 and a motor M6 for the double face unit. Although not shown, the path of travel of paper in the double face unit has a plurality of sensors. The fourth CPU 204 produces the above control signals in accordance with paper detection signals from these sensors.

Figure 20:
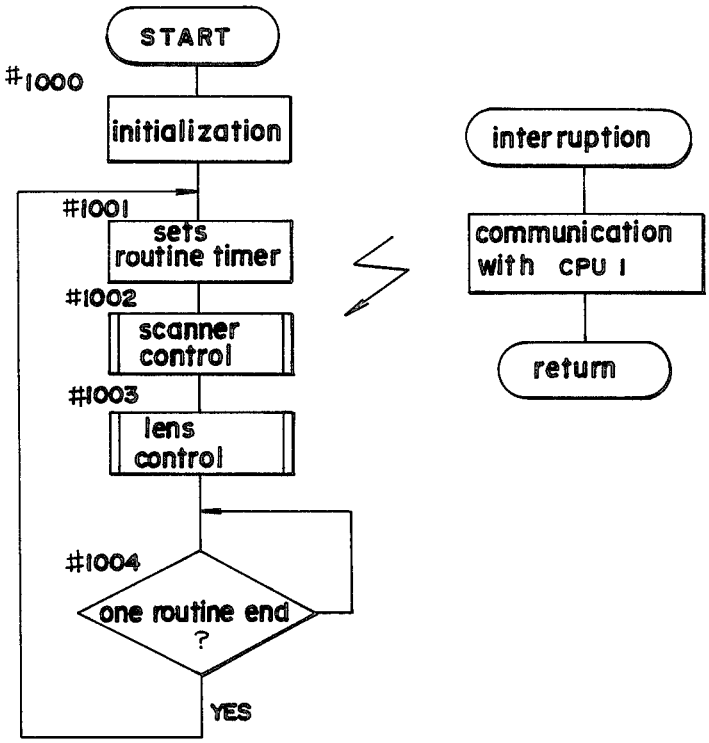
FIGS. 20 and 21 are flow charts showing the process to be performed by a second CPU.
Figure 21:
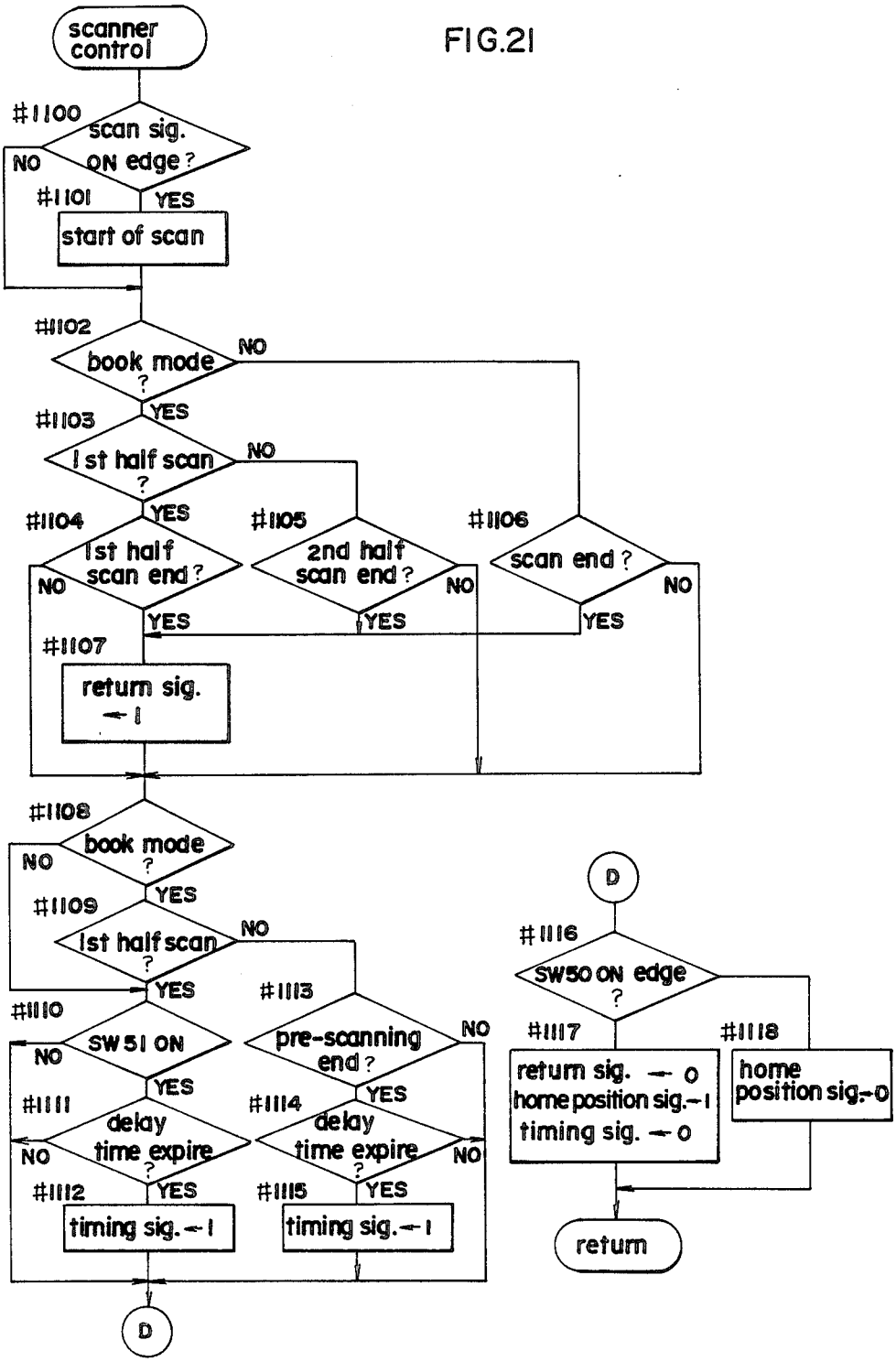
Figure 22:
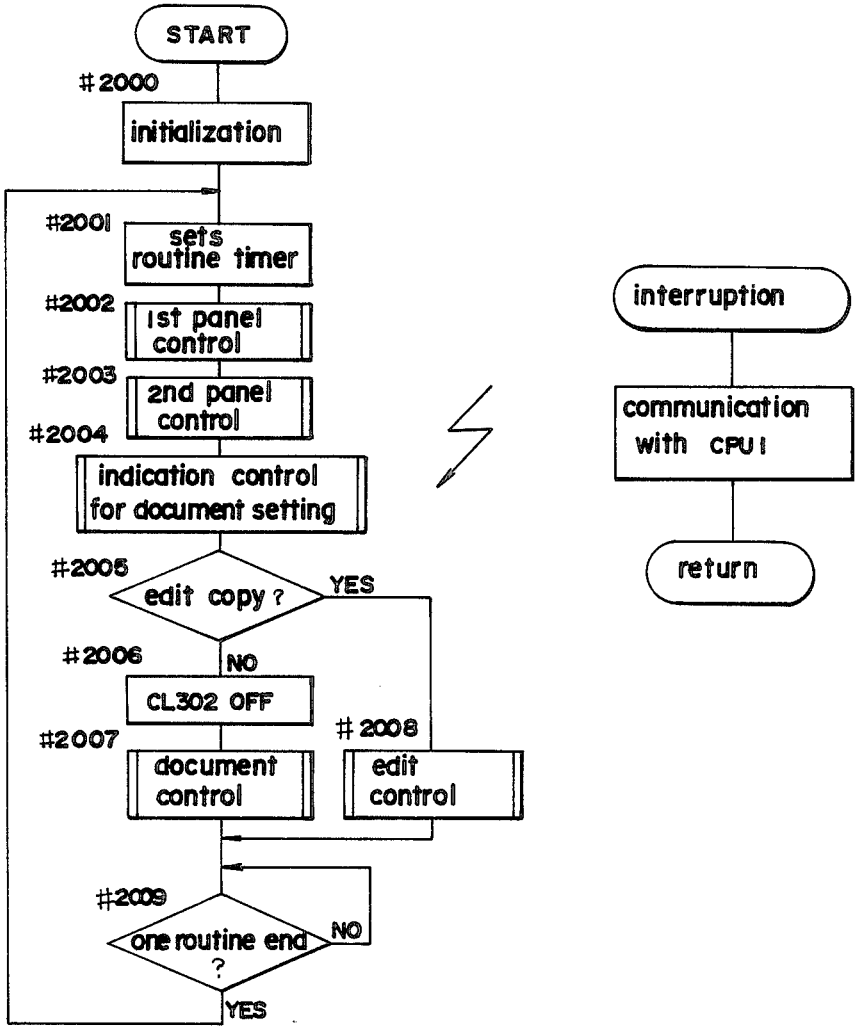
FIGS. 22, 23A, 23B and FIGS. 25A, 25B, 26, 27, 28, 29A, 29B, 29C are flow charts showing the process to be executed by a third CPU.
Figure 30:
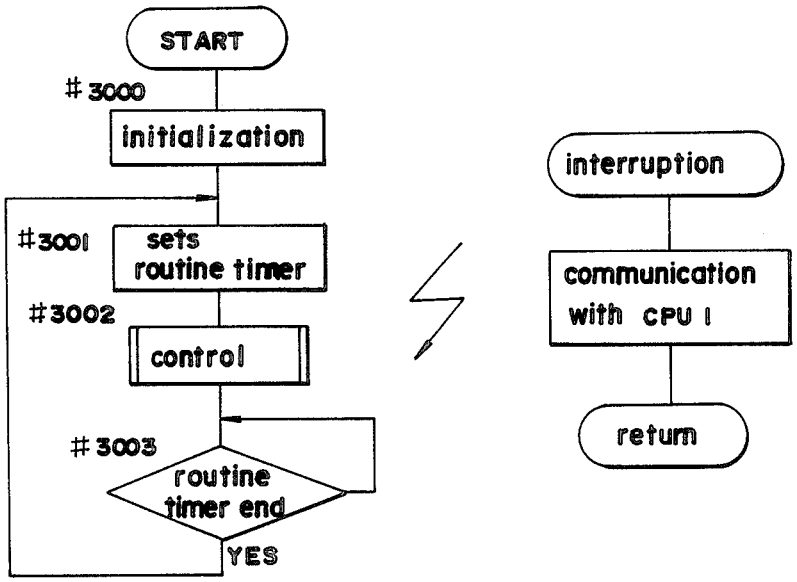
FIGS. 30 and 31 are flow charts showing the process to be executed by a fourth CPU.
Figure 31:
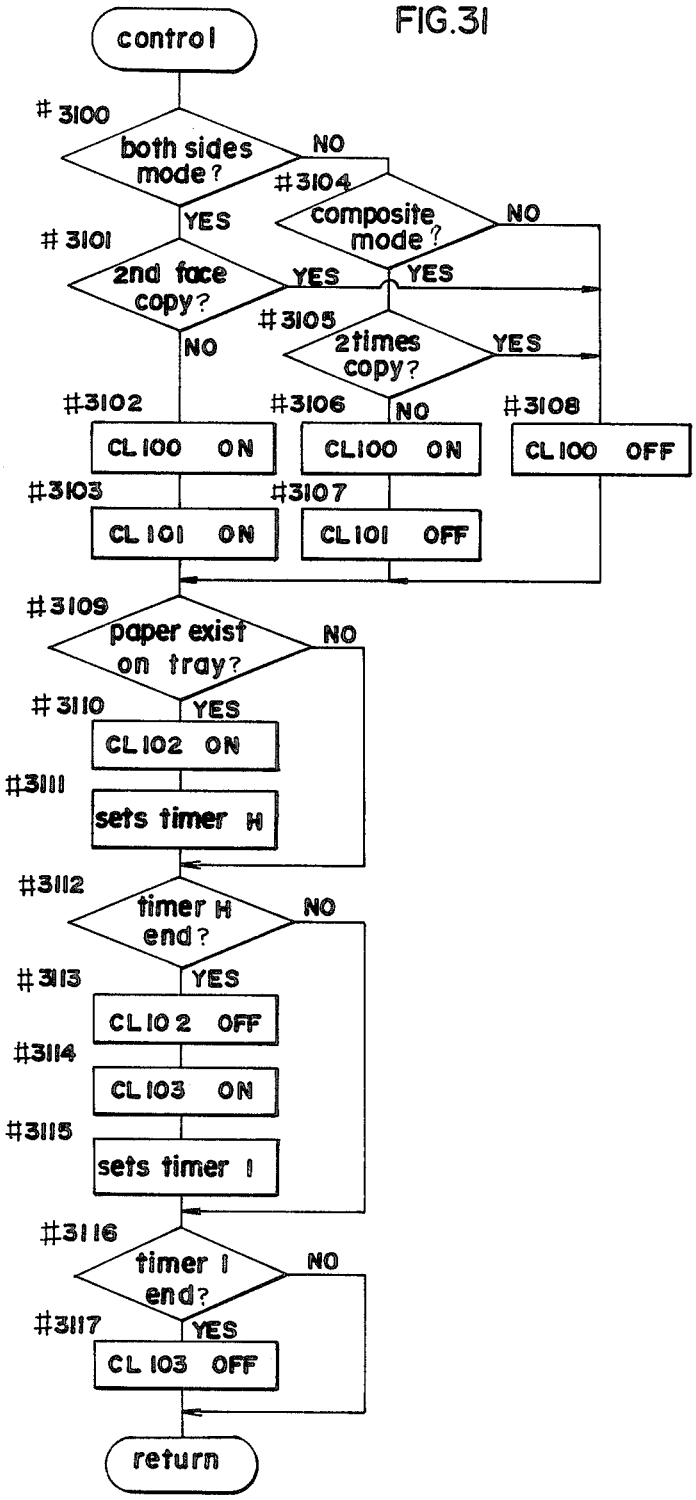

The control modes according to the invention will be described with reference to the flow charts. FIGS. 13 to 19 are flow charts relating to the first CPU, FIGS. 20 and 21 are flow charts relating to the second CPU, FIGS. 22 to 29 are flow charts relating to the third CPU, and FIGS. 30 to 31 are flow charts relating to the fourth CPU.

Figure 13:
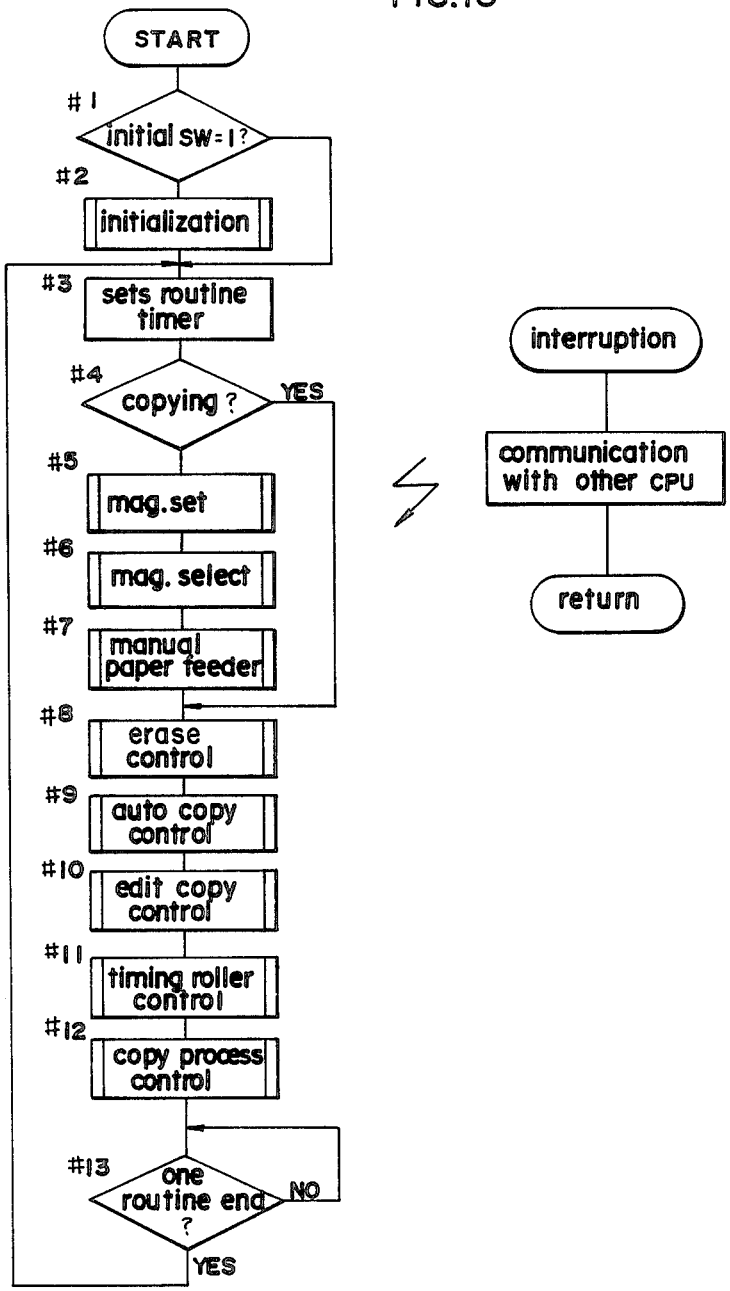
Figure 15:
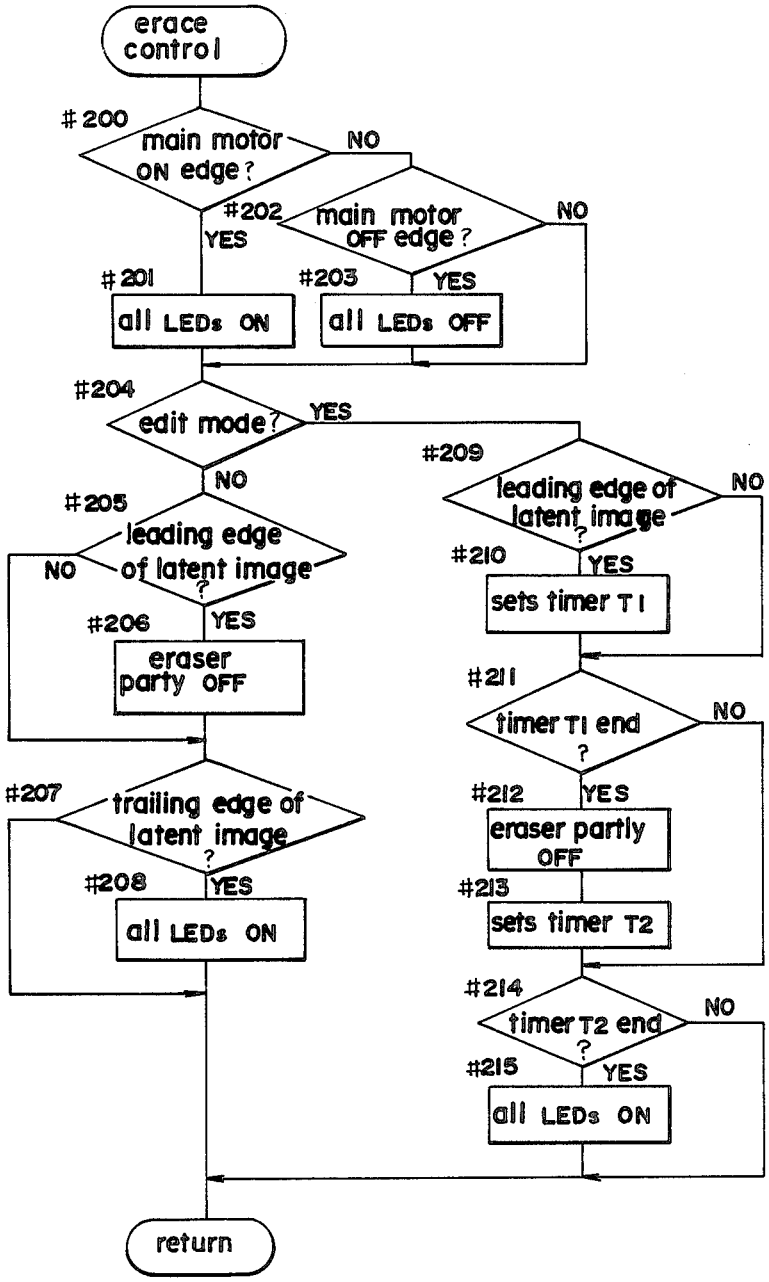

FIG. 13 shows the main routine for the first CPU. In steps #1 and #2, initialization is done upon closing of initial switch. In step #3, a routine timer is set for defining the time taken for one routine. The next step #4 checks whether the machine is in copying operation.

When the machine is found to be in a copying operation, step #8 follows. If otherwise, steps #5, #6 and #7 are performed for magnification setting subroutine a, magnification selection subroutine and a manual tray shift subroutine, respectively.

Magnification setting is done using the keys 95 to 98 and 100 to 103 on the operation panel of the copying machine and key 104 within the machine, and the magnifications are stored in the memories Q1 to Q8 in the CPU 203. For the selection of magnification, one of the keys 95 to 98 and 100 to 103 is depressed, whereby the magnification stored in the corresponding memory area is retrieved. Lens position setting and scanning speed setting are done according to the magnification. These procedures are already made known by U.S. Pat. No. 4,575,227 and will not be described.

Step #7 is the control subroutine to be executed in the copy edition mode for shifting a partial or fragmentary image in the perpendicular direction on copy paper. This step will be described with reference to FIG. 14.

The subsequent step #8 is a subroutine for controlling the inter-image eraser for preparing a fragmentary image by document edition. This step will be described in detail with reference to FIGS. 15 and 16.

Step #9 shows the control to be effected when the automatic magnification selection mode or automatic paper selection mode is selected for usual copying operation. This control is made known by application Ser. No. 561,571 and therefore will not be described.

Step #10 is the control subroutine to be executed when the edition paper selection mode or edition magnification selection mode is selected. This step will be described with reference to FIG. 17.

Step #11 is a subroutine for shifting the fragmentary image on copy paper in the feed direction by controlling the timing rollers 26, as will be described in detail with reference to FIG. 18.

Step #12 is a subroutine for controlling copying operation, as will be described in detail with reference to FIG. 19.

Upon lapse of the time set on the routine timer in the final step #13, the sequence returns to step #3. Communications with the other CPU's are conducted by interrupt processes.

Figure 14:
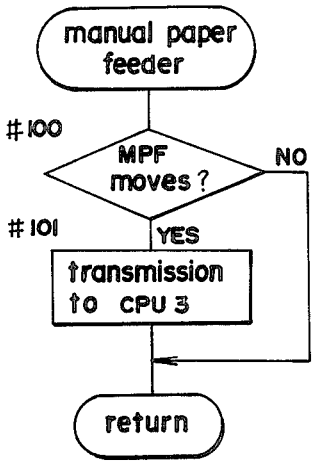
FIGS. 13 to 15, and FIGS. 17A, 17B, 18, 19A, 19B are flow charts showing the process to be performed by a first CPU.

Referring to FIG. 14 showing the manual feed tray shift subroutine, step #100 checkes whether the tray 40 has been shifted. If it is in the shifted position, the number of pulses indicating the amount of shift as detected by the pulse disk 43 and the sensor 44 is transmitted to the third CPU 203 in step #101. The third CPU 203 in turn shifts frame lines on the graphic display.

In the subroutine for controlling the inter-image eraser, steps #200 to #203 first detect on edge of the main motor M1, whereupon the entire eraser is turned on. At off edge, the entire eraser is turned off.

Step #204 checks whether the current mode is usual copying or edition copying. In the former mode, steps #205 to #208 are executed, whereas in the edition copying mode, steps #209 to #215 are performed. The sequence then returns to the main routine.

In the case of usual copying operation, the leading end of the latent image reaches the position of the inter-image eraser 400 in step #205. In step #206, the eraser elments over a length of eraser corresponding to the smaller of the paper width and the width of original multiplied by the magnification are turned off in step #206. When the rear end of the latent image reaches the position of the eraser in step #207, the eraser is entirely turned on in step #208.

In the case of edition copying, the leading end of the latent image arrives in step #209, whereupon a timer T1 is set for giving a time delay corresponding to the distance from the image leading end to the first image block. More specifically, the distance is divided by the system speed (peripheral speed v of the drum) and further multiplied by the magnification to obtain a value, which is set on the timer T1 in step #210. In steps #211 to #213, upon completion of the operation of the timer T1, the eraser is turned off only over a length corresponding to the width of the image area multiplied by the magnification, and the distance corresponding to the length of the image area is calculated and set on a timer T2. For this calculation, the image area length is divided by the system speed and further multiplied by the magnification. On completion of the operation of the timer T2 in step #214, the eraser is entirely turned on in step #215.

Figure 16:
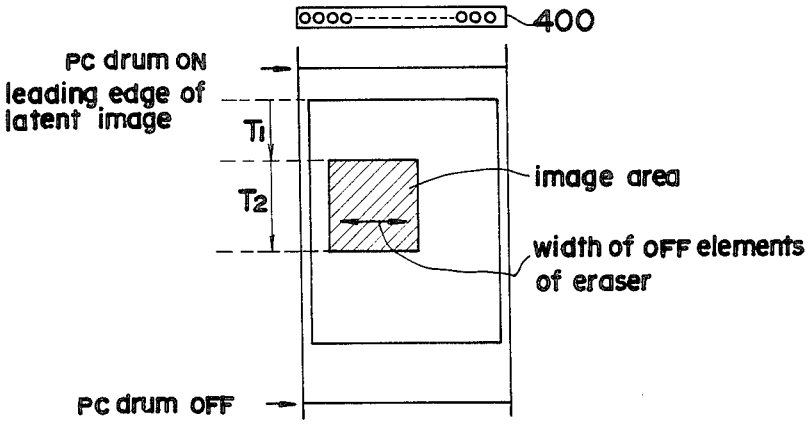
FIG. 16 is a diagram showing the range of an image to be erased by the inter-image eraser.

FIG. 16 schematically shows the partial or fragmentary image prepared by controlling the inter-image eraser as above.

Figure 17A:
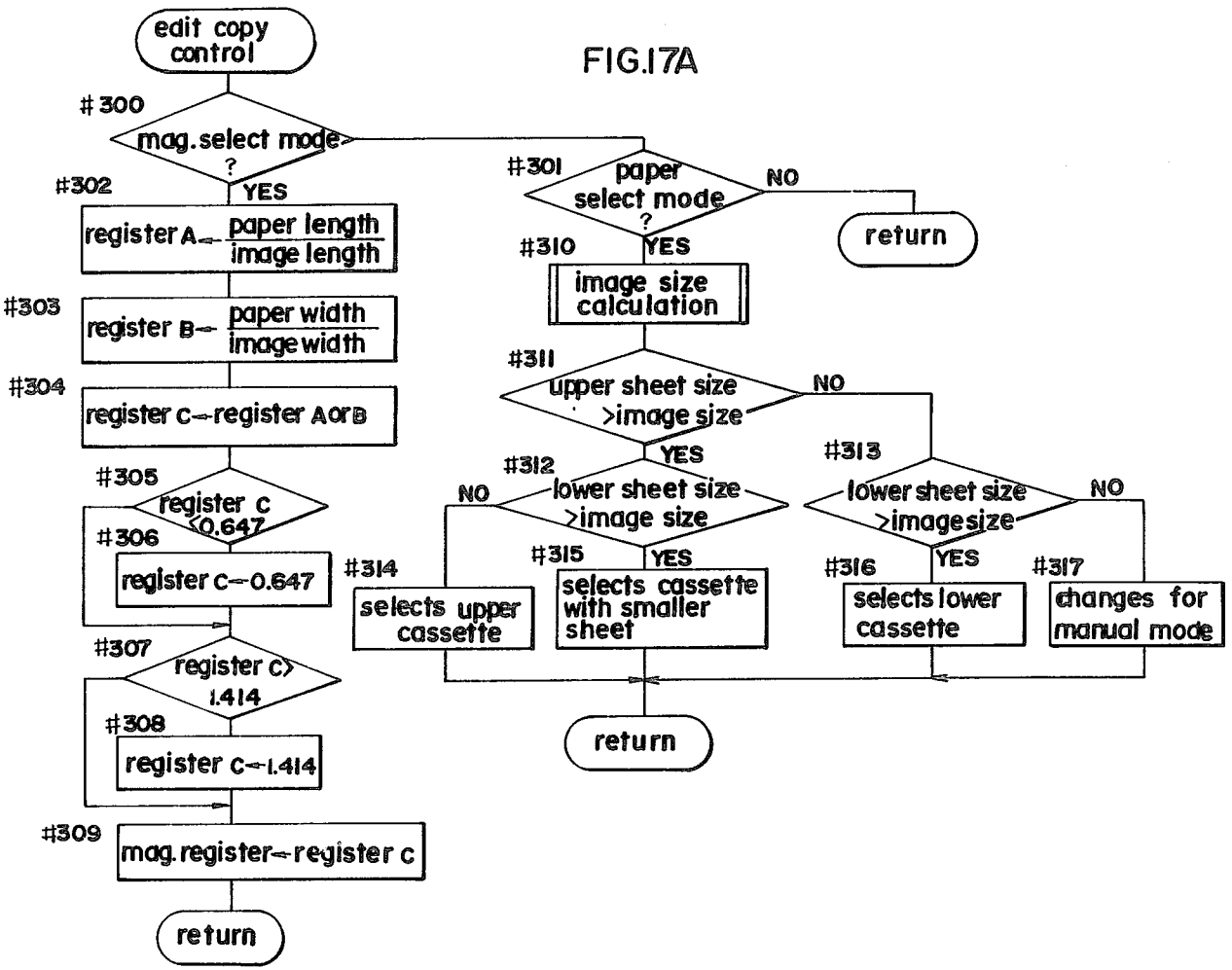
Figure 17B:
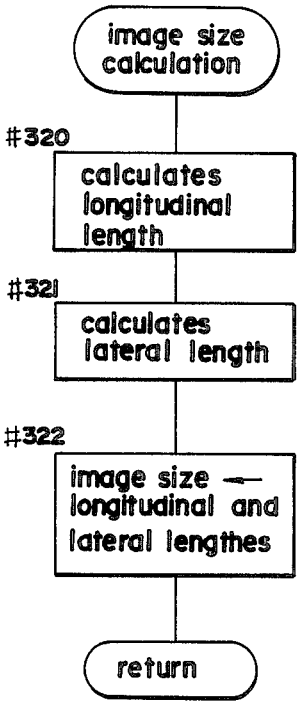

With reference to the subroutine shown in FIGS. 17A and 17B for automatic edition copy contol, steps #300 and #301 check whether the automatic edition magnification mode or automatic edition paper selection mode has been selected. Since the mode is set using the operation panel of the ADF. The setting is checked with reference to the mode signal from the third CPU 203.

When the current mode selected is the edition magnification selection mode, a value obtained by dividing the length of the copy paper to be used by the length of area of the original is fed to an A register in step #302. In step #303, a value obtained by dividing the width of the paper by the width of area of the original is given to a B register. The length of original (document) area is the actual maximum length of the original area DE along the direction of scan as indicated at Ll in FIG. 48, whereas the width of the original area is not the actual width of the area. It is to be noted that the width is the distance from a reference edge (hereinafter referred to as "side reference edge") 395 on which one edge of the original is positioned when the original is placed on the document support glass plate, to the edge of the area DE which is remotest from the side reference edge 395 , as designated at Lw in FIG. 48. This is because the image of the area will not always be accommodated on the paper depending on the position of the area, if the actual width of the area is used for calculation. In step #304, the smaller of the values given to the A and B registers is entered in a C register. If the value on the C register is smaller than the minimum magnification (0.647X) set for the copying machine, the minimum value is set in the C register in steps #307 and #308. If the value in the C register is greater than the maximum magnification (1.414X), the maximum value is set in the C register in steps #307 and #308. In step #309, the value in the C register is set in a magnification register.

When the current mode selected is automatic edition magnification selection, the above process automatically determines from the size of the specified area of the original and the paper size used a minimum magnification at which the fragmentary copy image can be entirely reproduced on the copy paper.

On the other hand, when the automatic edition paper selection mode is selected, step #310 first calculates the size of the copy image to be obtained. FIG. 17B shows a subroutine for calculating the image size. In step #320, the area length Ll of the original (see FIG. 48) is multiplied by the specified magnification to use the calculated value as the vertical length of the copy image. In the next step #321, the width Lw of the area of the original (see FIG. 48) is multiplied by the magnification to use the calculated value as the horizontal length of the image. These lengths are set in a register in step #322.

Referring to the flow chart of FIG. 17A again, the subsequent step #311 checks whether the size of paper in the upper cassette 20 is larger than the image size calculated by the procedure of FIG. 17B. The size is of course checked as to the vertical and horizontal lengths to determine whether the paper in the upper cassette completely covers the copy image. When the check result is "YES", a similar check is made for the paper in the lower cassette 22 in step #312. If there is no suitable paper in the lower cassette, the upper cassette is selected (step #314). When the paper sizes of the two cassettes are found appropriate, the cassette of the smaller size is selected (step #315).

If the interrogation of step #311 is answered by "NO", step #313 checks whether the paper size of the lower cassette is sufficiently large for the copy image. When the result is "YES" the lower cassette is selected (#316). If otherwise, the paper selection mode is changed to the manual mode because the current mode fails to permit complete copying.

Figure 48:
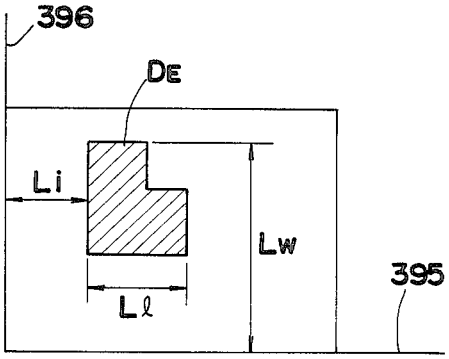
FIG. 48 is a diagram illustrating a document area in automatic edition magnification selection mode or in automatic edition paper selection mode.

When the current mode selected is automatic edition paper selection, the above process automatically determines from the size of specified area of the original and the magnification a paper size which completely covers the fragmentary copy image. When the specified original area selected is away from a reference edge 396 (hereinafter referred to as "front reference edge") of the support glass plate at which the front edge of the original is to be positioned as seen in FIG. 48, processing for paper feeding which is different from the usual processing is required. This will be described below with reference to FIG. 18.

Figure 18:
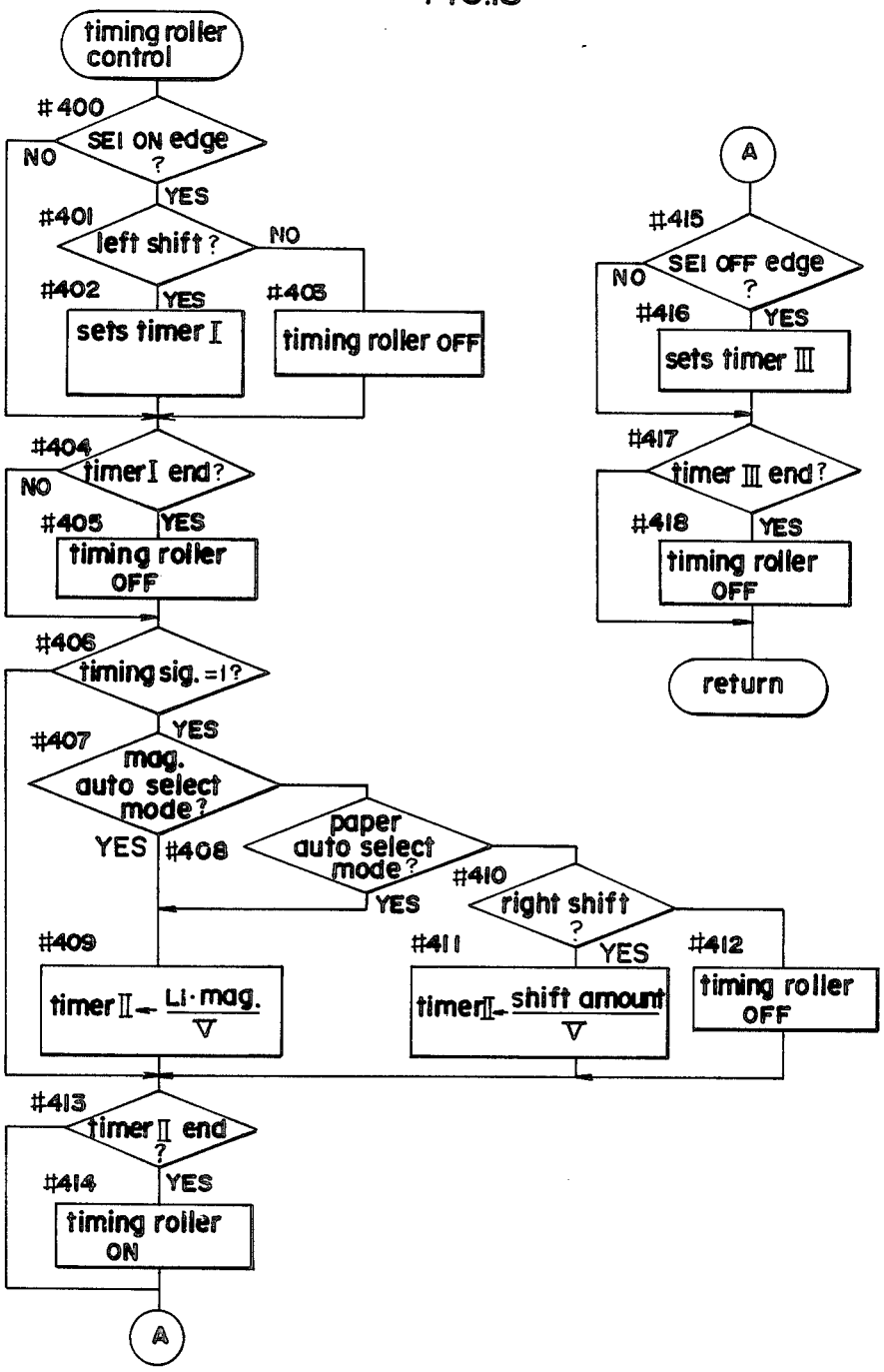

FIG. 18 shows a subroutine for controlling the timing rollers. In this subroutine, the timing rollers are so controlled as to feed copy paper earlier or later than the usual feed timing and thereby shift the image area relative to the paper in the feed direction as already stated. Further the subroutine is so designed that in the automatic edition magnification selection mode or in the automatic edition paper selection mode, the feed timing is delayed in corresponding relation to the distance between the specified original area and the front reference edge to properly position the area relative to the paper.

It is to be noted that before the subroutine is commenced, the timing rollers are already on according to the subroutine of FIG. 14 for copying operation.

First, step #400 checks whether the leading end of paper has actuated the sensor SEl disposed before the timing rollers 26. If it is on, the next step #401 checks whether the copy area is shifted leftward on the first operation panel 330, i.e., in a direction opposite to the feed direction. When the check result is "YES" the amount of the shift is divided by the system speed, and a value (obtained by dividing the distance between the sensor SEl and the timing rollers by the system speed) is added to the quotient to obtain a value, which is set on a timer I (#402). When there is no leftward shift, the timing rollers are immediately turned off (#403).

Subsequently, step #404 checks the timer I for the completion of its operation. On completion, the timing rollers are turned off in step #405. Thus, when the leftward shift is followed by these steps, the paper is stopped as forwarded beyond the timing rollers by a length corresponding to the amount of the shift.

Next, step #406 detects a timing signal which is produced a given period of time after the switch SW50 is actuated by the scanning system, whereupon steps #407 and #408 check whether the current mode selected is the automatic edition magnification selection or automatic edition paper selection. When the current mode is found to be either one, a value is set on a timer II in step #409 which value is obtained by dividing the distance Li shown in FIG. 48, i.e., the distance between the forward end of the specified copy area DE and the front reference edge 396, by the system speed and multiplying the quotient by the magnification.

When the current mode is neither of the two modes, step #410 checks whether the copy area is shifted rightward on the first operation panel 330. If the check result is "YES", the amount of the shift divided by the system speed is set on the timer II (#411). If the result is "NO" the timing rollers are immediately turned on (#412). Step #413 checks the timer II for the completion of its operation. On completion of the operation, step #414 turns on the timing rollers. Thus, when the copy area is in a rightward shifted position and when the area of the original specified in the automatic edition magnification or paper selection mode is away from the front reference edge, the feed timing for the timing rollers is later than the usual, whereby the copy image area is shifted toward the leading end of paper. Consequently the copy image can be entirely reproduced on the paper in the above-mentioned edition mode.

In steps #415 to #418, the passage of the rear end of the paper over the sensor SEl is detected, whereupon thc distance of the timing rollers from the sensor SEl divided by the system speed is set on a timer III. The timing rollers are turned off on completion of operation of the timer III.

Figure 19A:
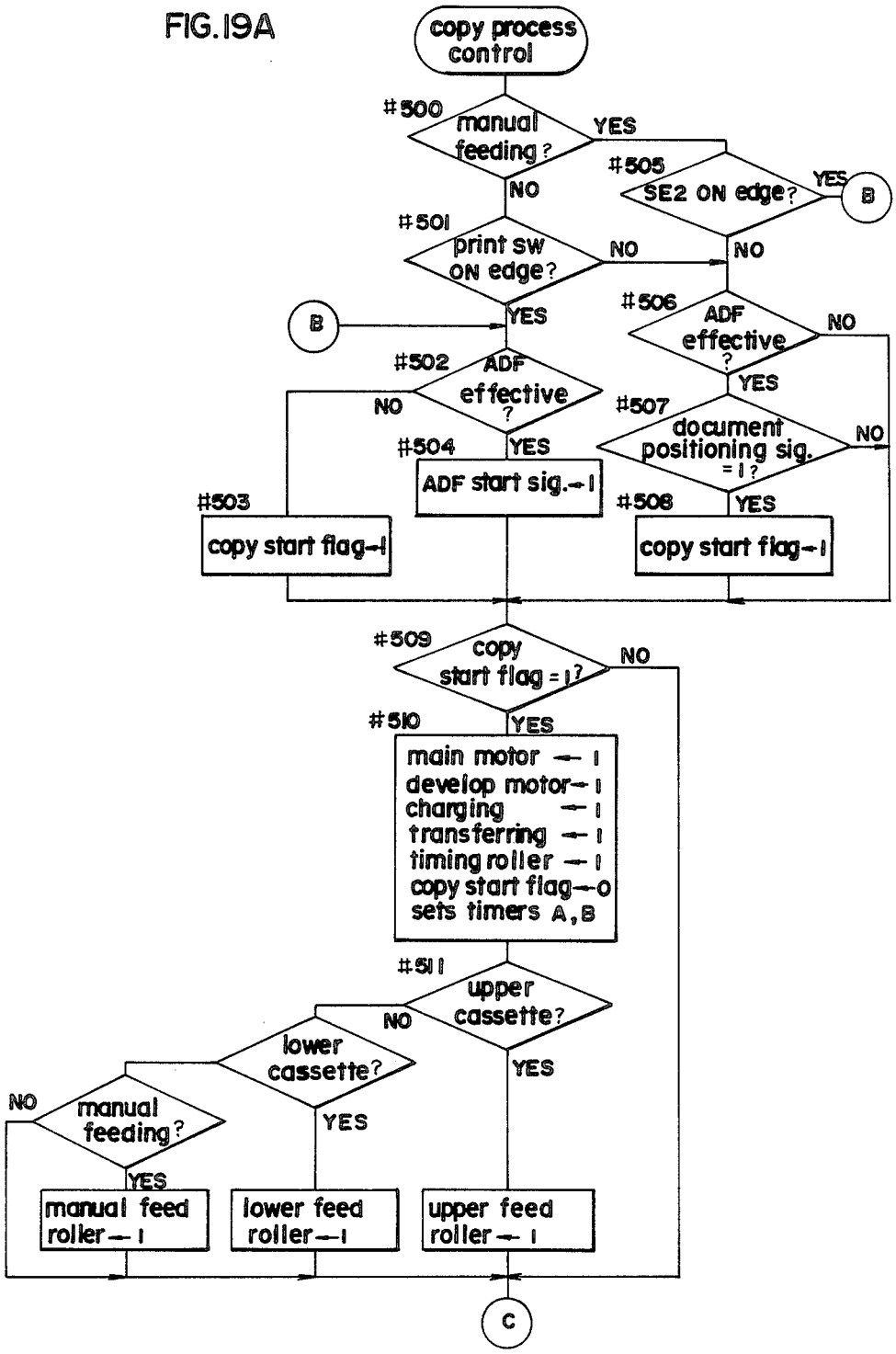
Figure 19B:
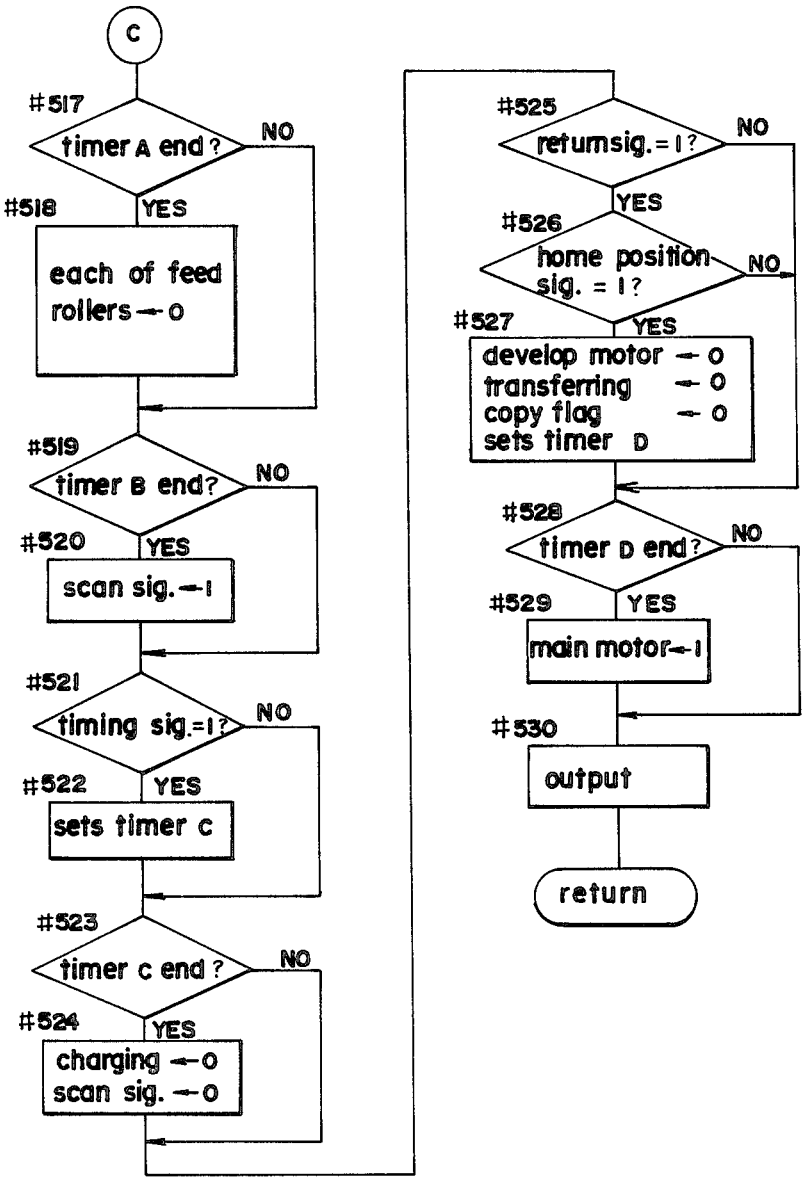

FIG. 19 shows a subroutine for controlling the copying operation. First, steps #500 to #508 check whether the paper is fed manually or by the cassette and further whether the ADF is used to give a control signal with timing specific to a particular combination.

Step #500 first checks whether the paper is fed manually, i.e., whether the manual feeder 40 is opened with reference to a signal from the sensor SE3. When the check result is "NO"(in the case of cassette feed), step #501 checks whether the print switch is on edge. If yes, step #502 checks whether the ADF is to be used. When the ADF is not used, a copy start flag is set (#503), followed by step #509. When the ADF is used, an ADF start signal is delivered (#504), followed by step #509.

On the other hand, when the inquiry of step #500 is answered with "YES", step #505 checks a sensor SE2 at the manual paper feed inlet as to whether it is on edge. If on edge, step #502 follows. If otherwise, step #506 checks whether the ADF is to be used. When the ADF is used, step #507 detects a document position signal indicating that the original is set in position on the glass plate 16. A copy start flag is then set (#508).

Briefly, when copying is started (print switch on or insertion of paper into manual paper feed inlet), the ADF is started to set the original in place, whereupon the copy start flag is set. When the ADF is not used in this case, the flag is immediately set.

The copy start flag in set position is detected in the next step #509, whereupon in step #510, the main motor, developing motor, sensitizing and transfer chargers and timing rollers are turned on, timers A and B are set, and the flag is reset.

In steps #511 to #516, in accordance with which of the upper cassette, lower cassette and manual feeder is selected, a clutch for delivering drive force to the corresponding feed roller is turned on.

The timers A and B set in step #510 are checked respectively in steps #517 and #519 for the completion of operation, followed by turning off of the feed roller and start of scan (#518, #520).

When the scanning system starts scanning and turns on the switch SW51, the second CPU 202 produces a timing signal a specified period of time after the switching (#521). The timing signal sets a timer C in step #522. On completion of operation of the timer C, the sensitizing charger is turned off, and the scan signal is changed to 0 (#523, #524). The timer C is set according to the paper size and magnification used.

In the second CPU, when the home position signal changes to 1 with the return of the scanning system as will be described later (#525, #526), the developing motor and transfer charger are de-energized, the copy flag is reset and a timer D is set in step #527.

Upon completion of operation of the timer D (step #528), the main motor is turned off in step #529.

Although the operation of external devices has been described as being controlled step by step, the control signals, flags, etc. are merely set within the microcomputer in actuality, and such control signals are all fed out in step #530.

FIG. 20 shows the main routine of the second CPU for controlling the scanning system and lens system. With reference to this drawing, the initialization of step #1000 is followed by step #1001 in which a routine timer is set, and by steps #1002 and #1003 for scanner control and lens control. On completion of the routine timer operation in step #1004, the sequence returns to step #1001. Communications with the first CPU are conducted by interruption.

The subroutine of scanner control will be described later with reference to FIG. 21. The lens control subroutine, in which the lens is shifted to a position corresponding to the selected magnification, is executed in the same manner as in the prior art and will not be described.

With reference to FIG. 21 showing the scanner control subroutine, step #1100 detects a scan signal on edge to start scanning in step #1101. The scan signal is set in step #521 of FIG. 19.

In the next step #1102, whether a book mode is selected is checked. The book mode is disclosed, for example, in U.S. Pat. No. 4,017,173. In this mode, the front half page and the rear half page of a spread of a book as placed on the glass plate 16 are copied separately. The copying machine of this invention is set in this mode when book is selected as document on the second control panel. When one single-faced copy is selected, the specified front or rear half page is copied. When two single-faced copies is selected, the front half page and the rear half page is copied on separate sheets of paper. When double-faced copy is selected, the front half page and the rear half page are copied on the front and rear surfaces of a single sheet of paper. When an edition or composite instruction is given at the same time, the front half page and/or the rear half page will be copies as the specified original in accordance with the instruction.

The size of the page may be entered by suitable means. Alternatively, an index movable in the scan direction may be provided at one side of the glass plate, such that the position of the index as set to the fold of the spread is detected.

Referring again to the flow chart, on completion of scanning of the front and rear half pages, scan completion, return start and return signals are emitted in steps #1103 to #1105 and #1107.

On the other hand, when the current mode is not the book mode, scan is done only over a range calculated from the paper size and the magnification (paper length divided by the magnification, or the full scan length if the value is greater than the full scan length) in step #1106 before step #1107.

Steps #1108 to #1112 then follow, in which a timing signal is given a specified period of time, in accordance with the magnification, after the actuation of SW51 by the scanning system. In the case of the rear half page in the book mode, a timing signal is given a specified period of time, in accordance with the magnification, after the point of completion of the front half page has been passed (#1113 to #1115).

When the switch SW50 for detecting the scanning system in the home position is on edge, return is completed, the return signal and timing signal are changed to "0", and the home position signal is changed to "1" in the following steps #1116 to #1118. The home position signal is "0" except on edge.

FIGS. 22 to 28 are flow charts for the third CPU which controls the ADF. The main routine shown in FIG. 22 includes step #2000 for initialization, step #2001 for setting a routine timer, and steps #2002 to #2004 in which subroutines are executed for the first operation panel 330, the second operation panel 360 and display 380. Subsequently, step #2005 checks whether the operation is directed to edition copy. If the check result is "NO", the clutch CL302 is de-energized to deliver the original onto the discharge tray in step #2006, followed by step #2007 of document control subroutine. On the other hand, if the inquiry of step #2005 is answered with "YES",step #2008 follows for edition control subroutine.

Finally, on completion of the routine timer operation in step #2009, the sequence returns to step #2001. Communications with the first CPU are conducted by interrupt processes.

Figure 23A:
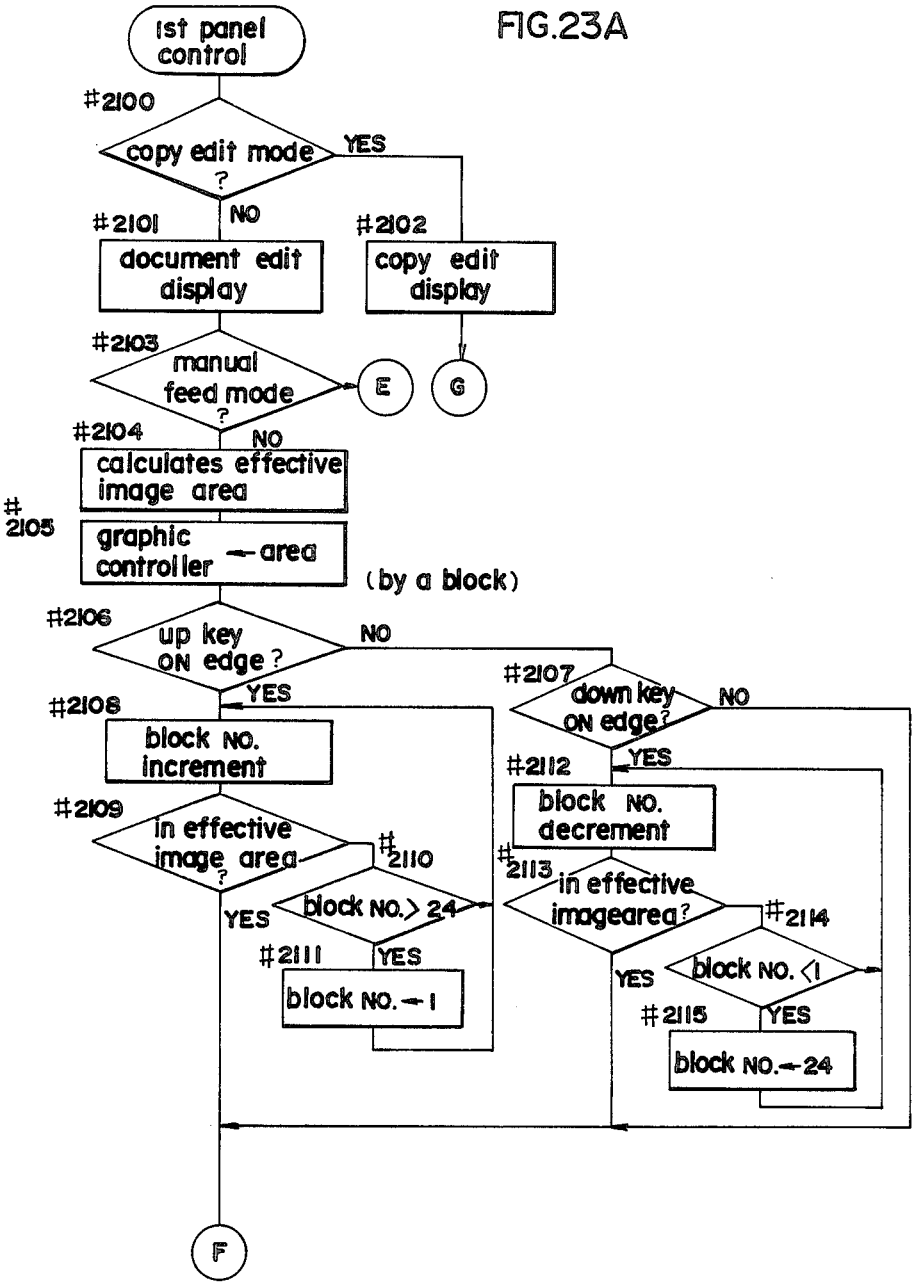
Figure 23B:
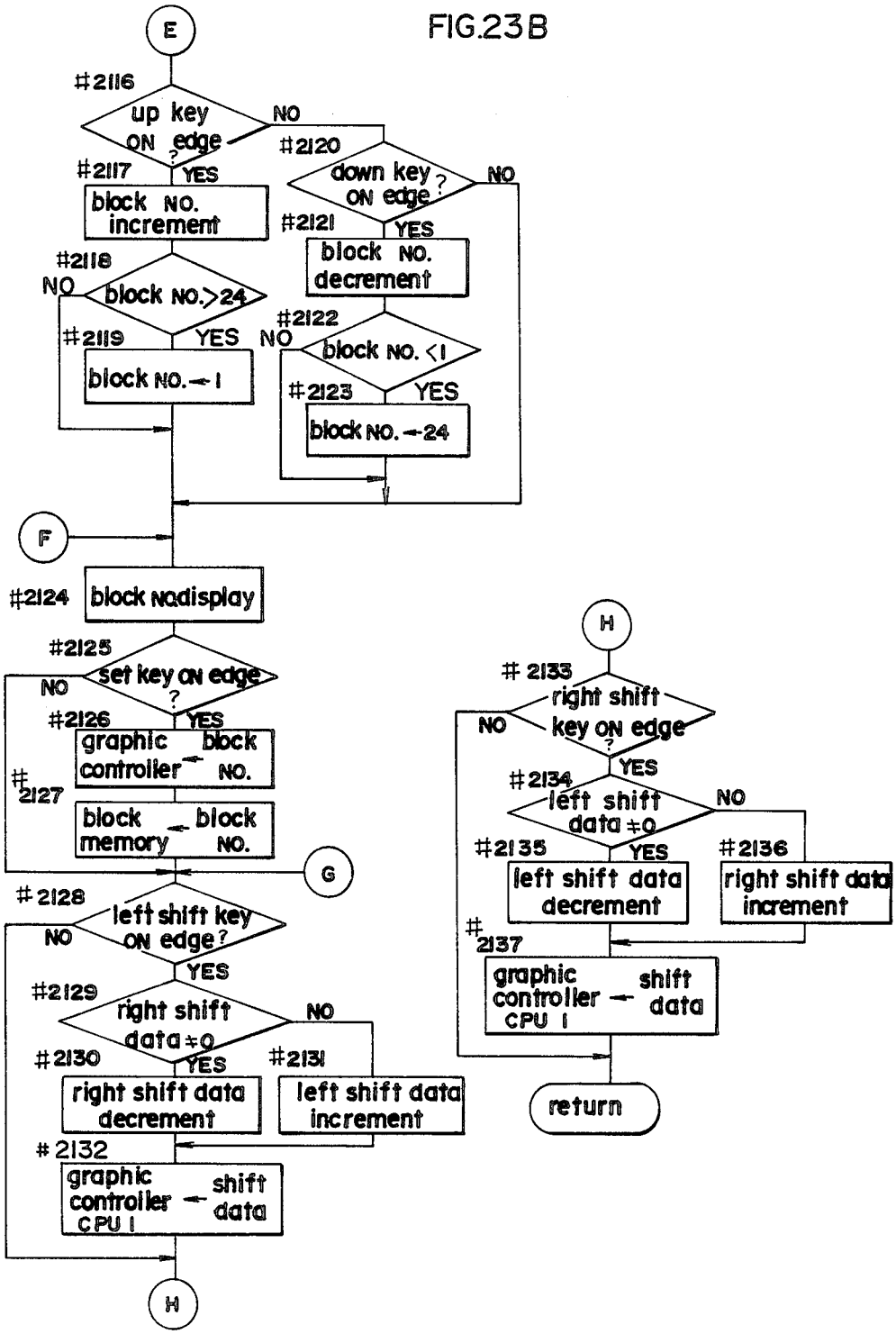

FIG. 23 shows the subroutine for controlling the first operation panel 330. First in steps #2100 to #2102, the display on the graphic display portion 331 is changed in accordance with the selected mode, using the edition selection key 361 on the second control panel 360. When the current mode is found to be other than the copy edition mode with reference to the mode signal obtained by inter-CPU communication, original (document) edition image bearing surface is shown. In the case of the copy edition mode, the copy edition surface is shown in step #2102, whereupon the sequence proceeds to step #2128.

Step #2103 checks which of the manual mode and cassette mode is selected according to whether the manual feeder 40 is open.

Figure 24A:
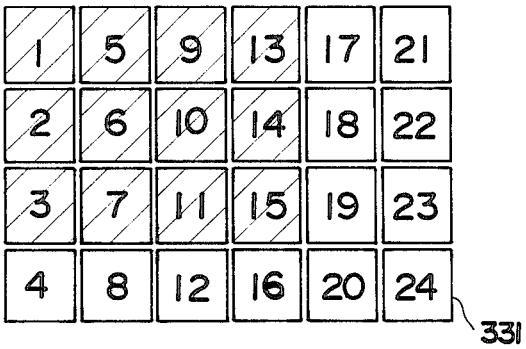
FIGS. 24A to 24C, are diagrams showing the graphic display in operation.
Figure 24B:
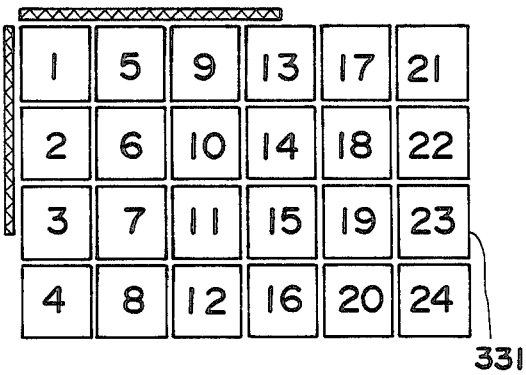

In the case of the cassette mode, an effective copy image area is calculated from the paper size and the magnification in step #2104. The calculated effective area is not always in coincidence with an area of block units, so that a maximum area of block units within the effective image area is determined as the effective image area in step #2105 and the result is given to the graphic controller to display the area by hatching as shown in FIG. 24A. Alternatively, line indicators may be provided along two sides of the graphic display portion 331, the length of the lines being variable according to the size of the effective image area.

In the cassette mode, the up key 333 and the down key 334 for specifying the document area are checked for on edge in steps #2106 and #2107.

When the up key 333 is depressed, the block number is incrementally increased in step #2108. If the block number is outside the effective image area, step #2108 is repeated. If the block number exceeds a maximum (24 in the present embodiment), the block number is changed to "1" (#2109 to #2111).

When the down key 334 is depressed, the block number is decrementally decreased similarly in steps #2112 to #2115.

When step #2103 founds that the selected mode is the manual feed mode in which the size of the paper to be fed is not known, the entire area is handled as being effective, the block number is incrementally or decrementally changed every time the up key 333 or down key 334 is on edge (#2116 to #2123).

Figure 24C:
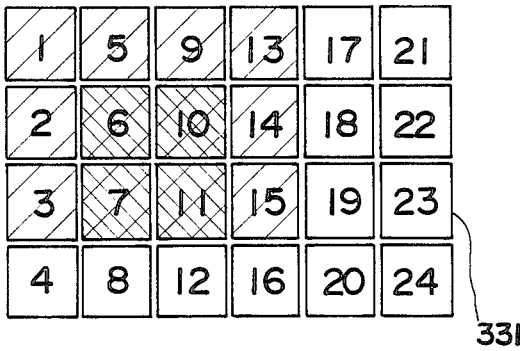

The block number thus set is shown on the block number display 332 in step #2124. When the setting key 335 is depressed for the block number on display (#2125), the block number is sent to the graphic controller 392 to display the set block area in black as seen in FIG. 24C. (The display color changes with the kind of the display elements used. The color display need not always be used insofar as the set area can be distinguished from the initial display and effective image area.) The block number is stored in the block memory (#2126, #2127).

The following steps #2128 to #2132 and #2133 to #2137 are concerned with the shift of copy image area in the feed direction in the copy edition mode. The shift of copy area toward the feed direction on copy paper is herein called left shift, and the shift in a direction opposite to the feed direction is called right shift for the sake of convenience. This is because when an area is specified with the face of the original up, the left side of the original is positioned toward the feed direction according to the present invention. According to the present embodiment, left shift data, as well as right shift data, is set based on a reference case wherein the specified area on the original is copied on paper as it is without shifting. With reference to the flow chart, the left shift key 336 on edge is detected in step #2128. If right shift data is already present, the data is reduced to "0" decrementally by depressing the left shift key 336, and left shift data is thereafter incrementally increased (#2129 to #2131). The set items of right shift data and left shift data are transferred to the graphic controller 392 and the first CPU 201 (#2132). Based on the data, the graphic controller 392 shifts the copy area leftward on the copy edition mode display, while the first CPU 201 controls the timing rollers as shown in the flow chart of FIG. 18 in accordance with the shift data.

The same procedure as for the left shift key is followed for the right shift key 337 in steps #2133 to #2137.

Figure 25A:
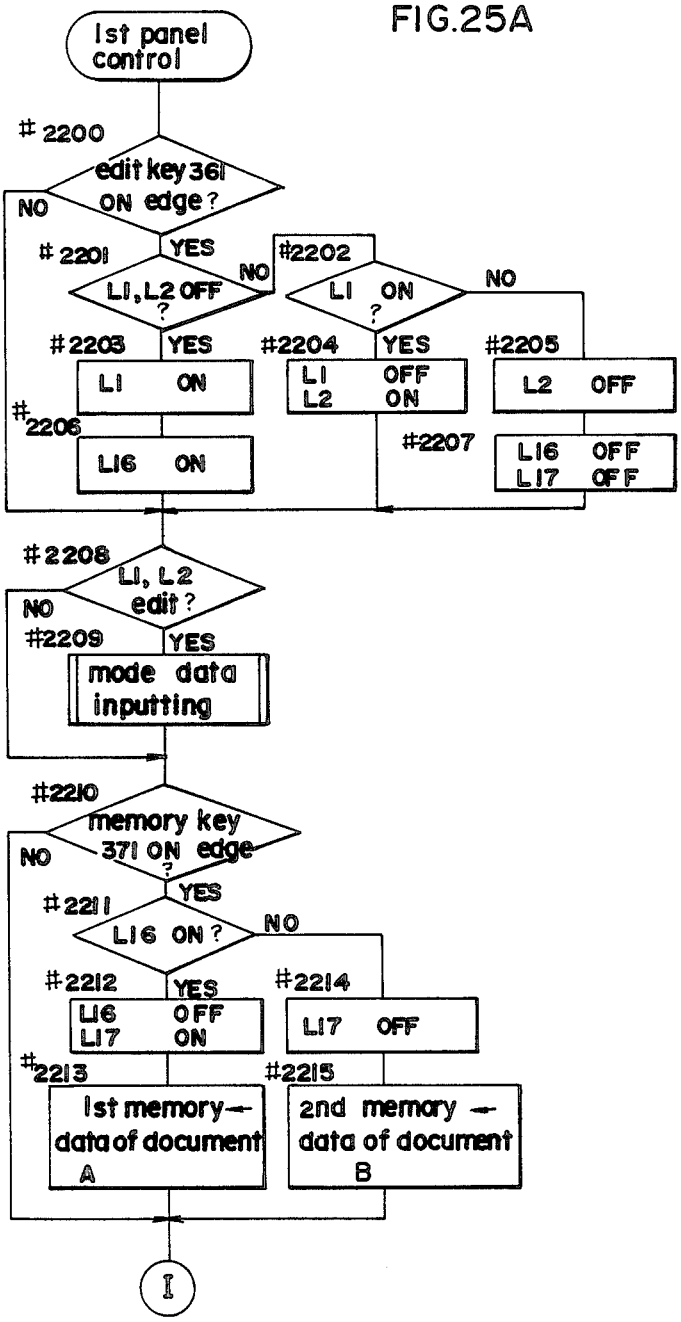
Figure 25B:
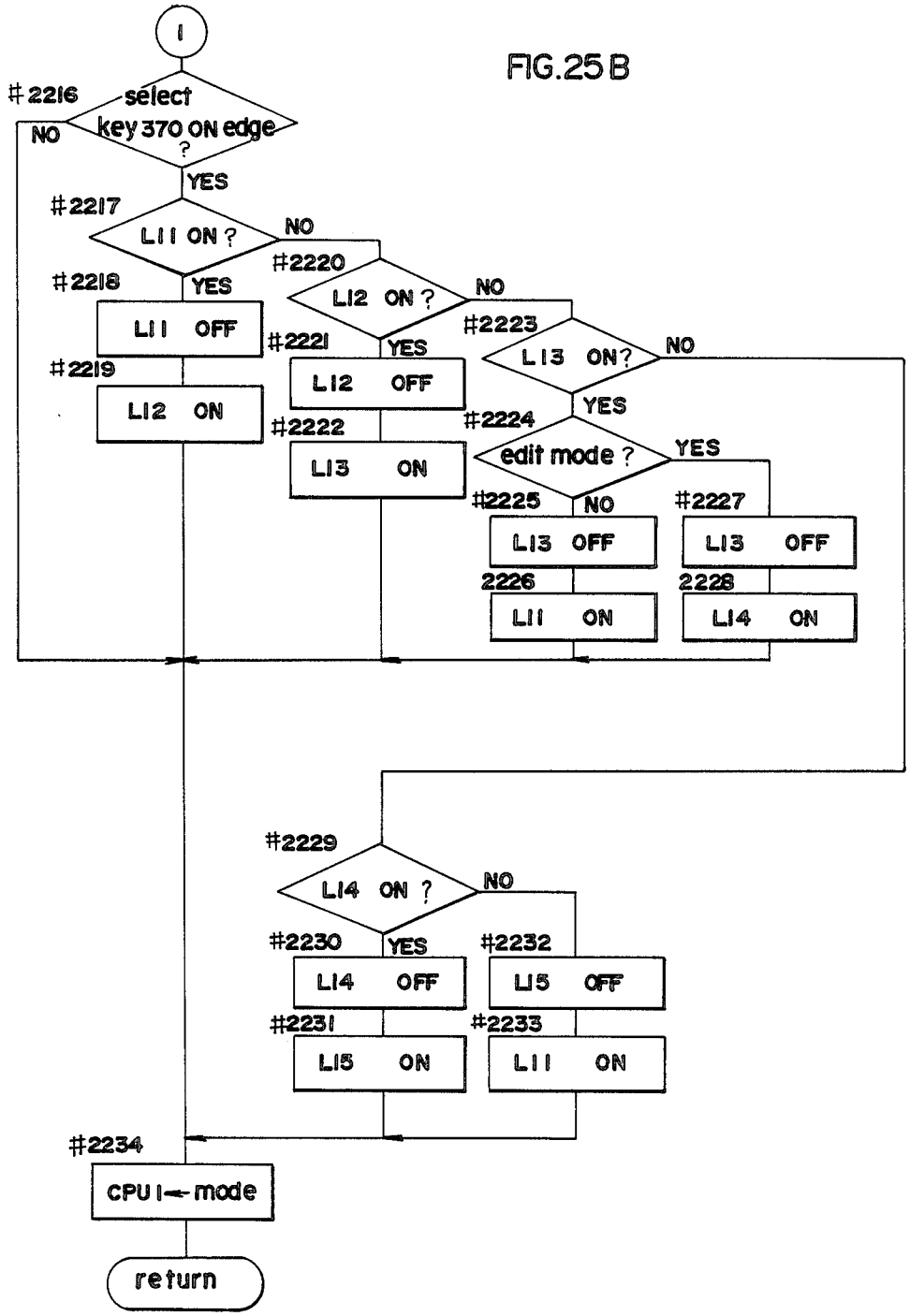

FIG. 25 shows the subroutine for the second operation panel 360. First, steps #2200 to #2205 effect on-off control of the lamp Ll representing the document edition mode and the lamp L2 representing the copy edition mode every time the edition selection key 361 is depressed. Both lamps, when off, represent the usual copying mode. Along with these displays, mode flags are used for various kinds of control. The lamp L16 for A original is turned on in step #2206, and both lamps L16, L17 for A and B originals are turned off in step #2207.

When the system is found to be either document edition mode or copy edition mode in step #2208, document mode and copy mode inputs are accepted in step #2209. Step #2209 will be described as a subroutine of FIG. 25.

Step #2210 detects the mode memory key 371 on edge. When the lamp L16 is on, indicating readiness for accepting mode setting for A original, the lamp L16 is turned off, the lamp L17 is turned on, and the mode so far set for A original with use of the first and second operation panels is stored in a first mode memory (#2211 to #2213).

When the inquiry of step #2211 is answered with no, this indiates readiness for accepting mode setting for B original (lamp L17 on), so that the lamp L17 is turned off, and the mode for B original is then stored in a second memory (#2214, #2215).

In the following steps #2216 to #2233, the mode selection key 370 is depressed for changing copying modes. One mode is changed over to another mode every time the key 370 is turned on. For example, when the mode selection key is depressed in the automatic paper selection mode (lamp Lll on), the lamp Lll is turned off, the lamp L12 indicating the next automatic magnification selection mode is turned on, and the corresponding flag is set. Similarly, the modes are changed one after another. The check of step #2224 as to the edition mode is done by detecting the document edition mode or copy edition mode selected by the edition selection key 361. Finally, the mode selected is transferred to the first CPU 201 in step #2234.

Figure 26:
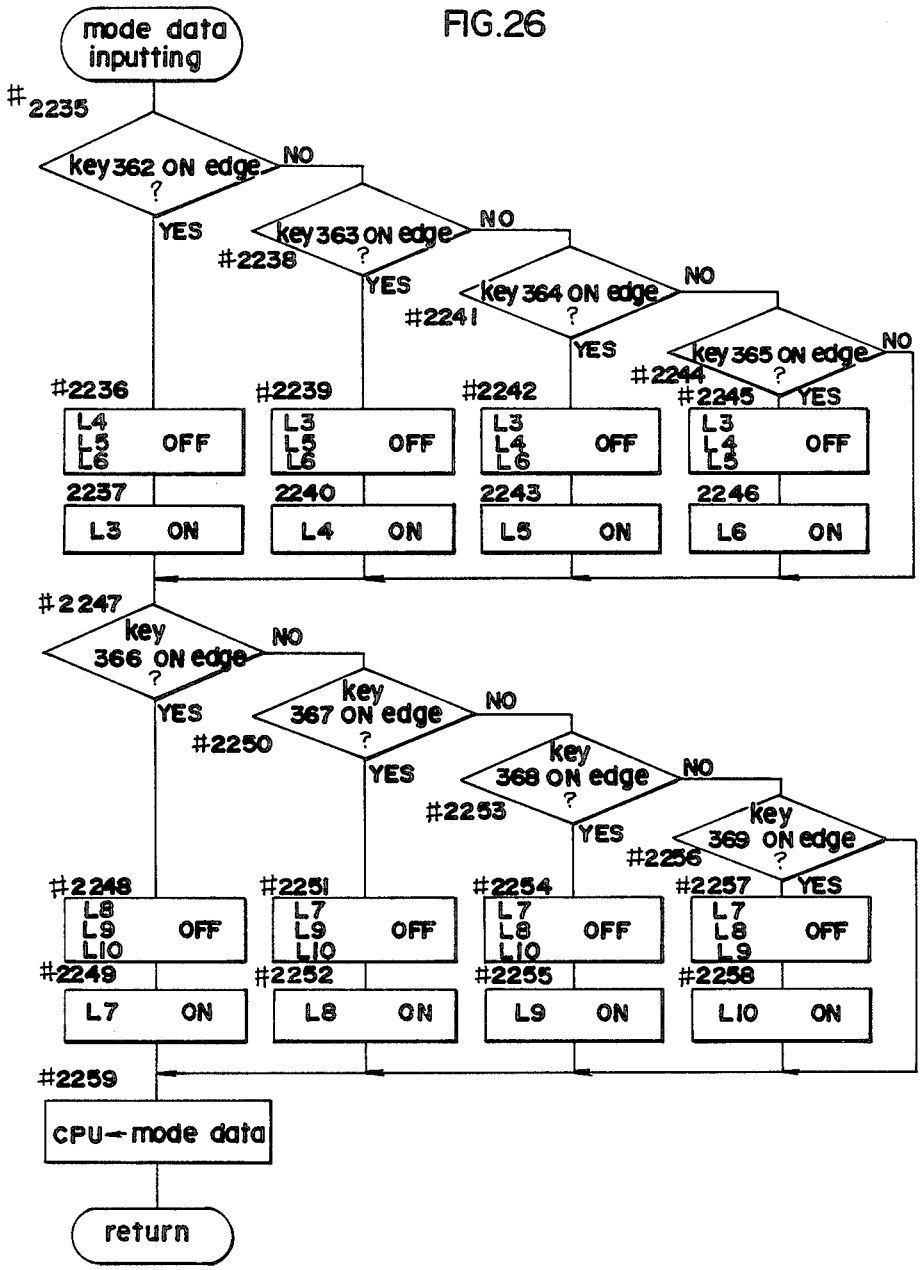

The step #2209 of FIG. 25 is shown as a subroutine in FIG. 26. In this routine, a combination of original and copy is selected by the keys 363 to 369 in the center of the second operation panel.

Steps #2235 to #2245 are steps for selecting a kind of original. When one of the keys 362 to 365 for specifying one single-faced original, two single-faced originals, double-faced original and book original is depressed, the corresponding one of the lamps L3 to L6 is turned on, with the others off.

Similarly, steps #2247 #2258 are steps for selecting a kind of copy. When one of the keys 366 to 369 for one single-faced copy, two single-faced copies, double-faced copy and composite copy is depressed, the corresponding one of the lamps L7 to L10 is turned on, with the other lamps off.

The original and copy modes selected are forwarded to the first CPU 201 in step #2259.

Figure 27:
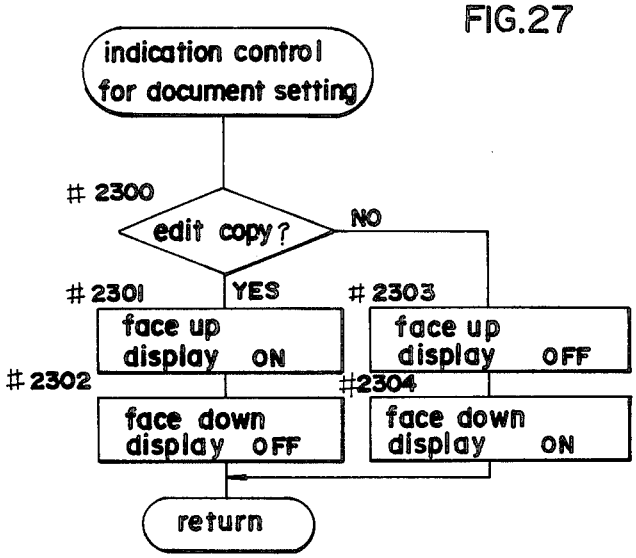

FIG. 27 shows a subroutine for controlling the display 380 of FIG. 9. For the edition mode, the lamp L18 is turned on, indicating that the original is to be set face up, while the lamp L19 is turned off, indicating that the original should be set face down (#2300 to #2302). For the usual mode, the on-off relation is reversed (#2303, #2304).

With the copying machine of the present invention, the original for document edition is placed on the feed tray of the ADF face up for the specification of area and is thereafter fed as it is, as already stated. The original is turned upside down by the reverse assembly and then positioned on the glass plate 16. In the usual mode, the original is set face down as in the prior art. To enable the user to set the original face up or down according to the mode selected without an error, the lamps L18 and L19 indicate the state in which the original is to be set.

Figure 28:
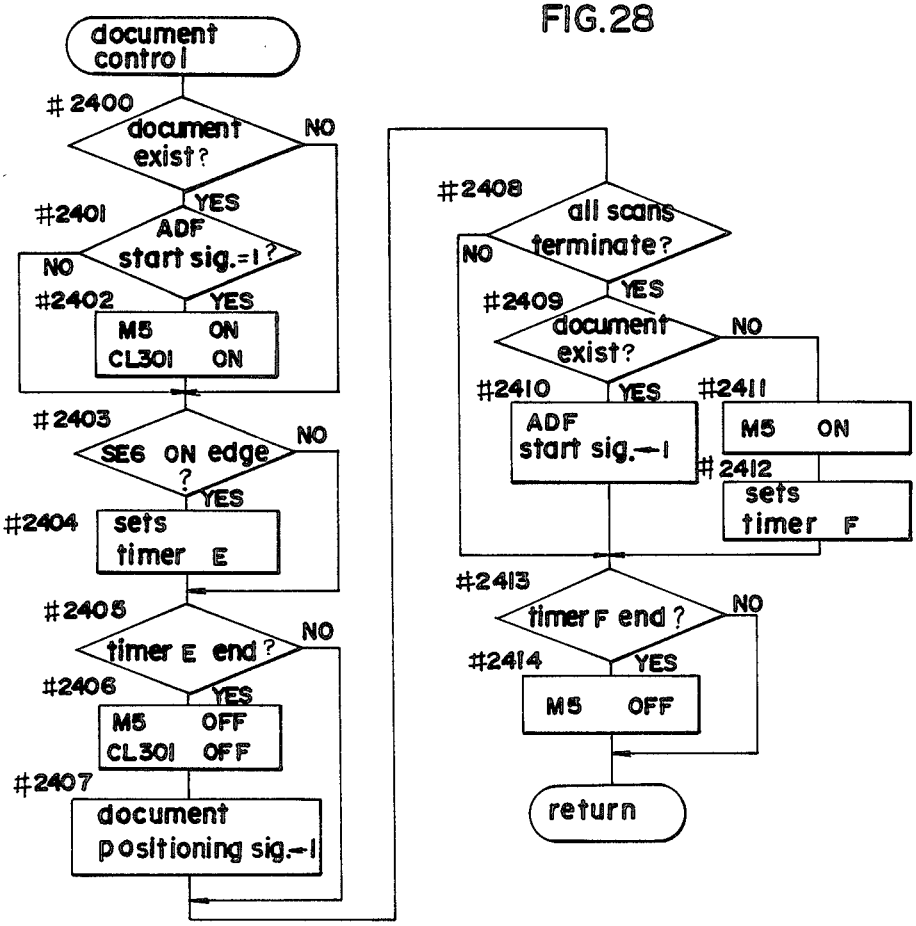

FIG. 28 shows a subroutine for controlling the ADF in the usual copying mode. In steps #2400 to #2402, the ADF motor M5 and the document feed clutch CL301 are turned on condition that there is an original on the document tray (detected by an unillustrated sensor) and that the ADF start signal is "1" (step #504 in FIG. 19). Next, the document sensor SE6 detects the rear end of the original (#2403), whereupon a period of time taken for the rear end to reach the exposure start position on the glass plate 16 is set on a timer E (#2404). When the completion of operation of the timer E is detected in step #2305, the motor M5 and the clutch CL301 are turned off (#2406). Step #2407 changes the document home position signal to "1". The home position signal is detected in step #507 of FIG. 19, whereupon a copying operation is started.

In the usual copying operation, two or more originals will be copied, so that after the set number of originals have been copied (#2408), step #2409 checks whether there is any original on the document tray. If there remains an original, the ADF start signal is changed to "1", and the original is fed (#2410). In practice, the motor, etc. are turned on in step #2402 of the next cycle. If there is no original, the motor M5 is turned on to discharge the original on the glass plate 16 (#2411), and a timer F is set (#2412). The completion of operation of the timer F is detected in step #2413, whereon the motor M5 is turned off (#2414).

Figure 29A:
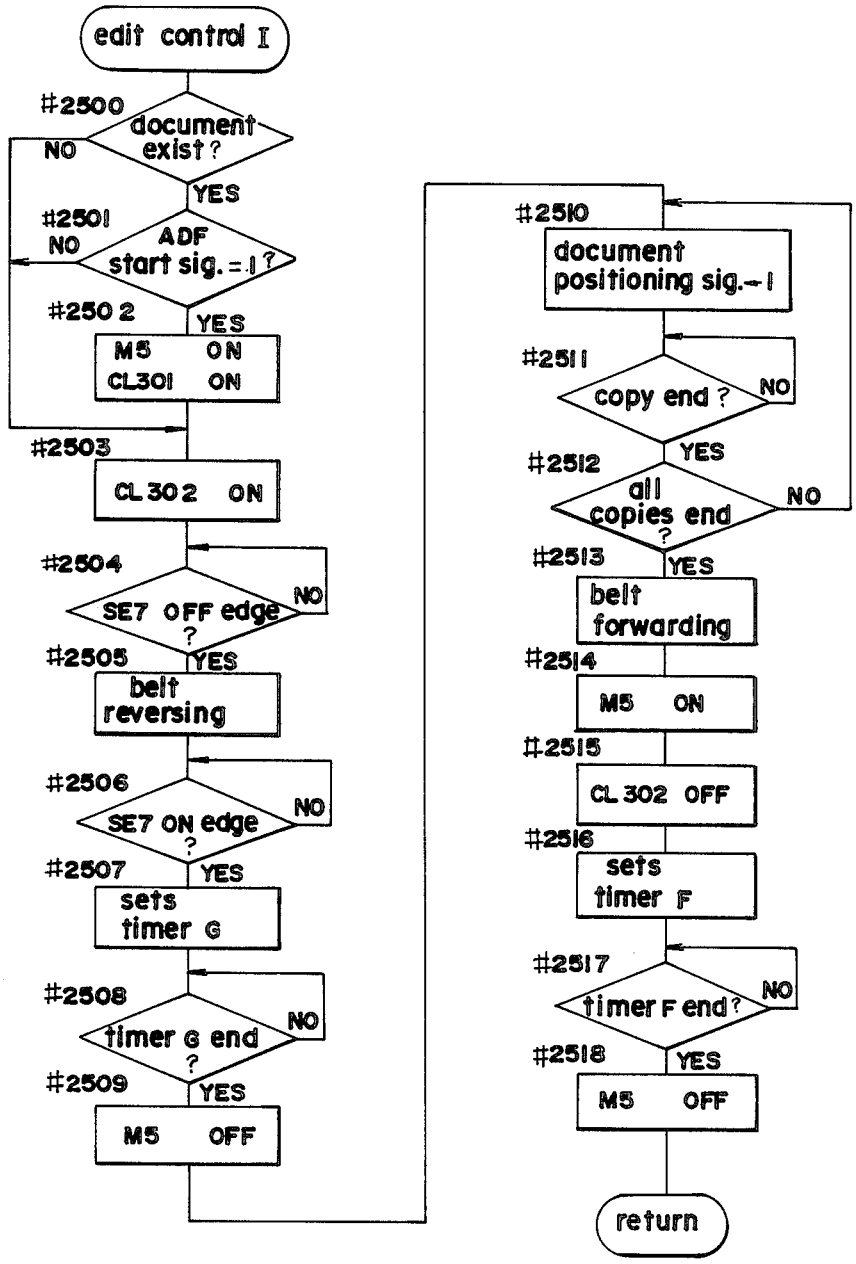
Figure 29B:
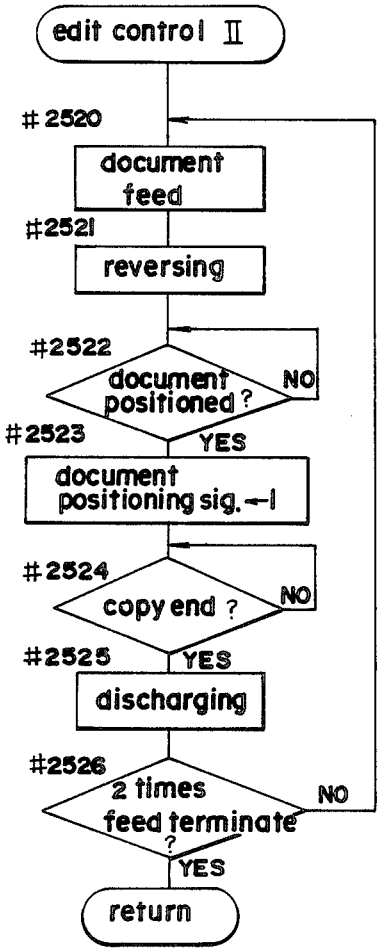
Figure 29C:
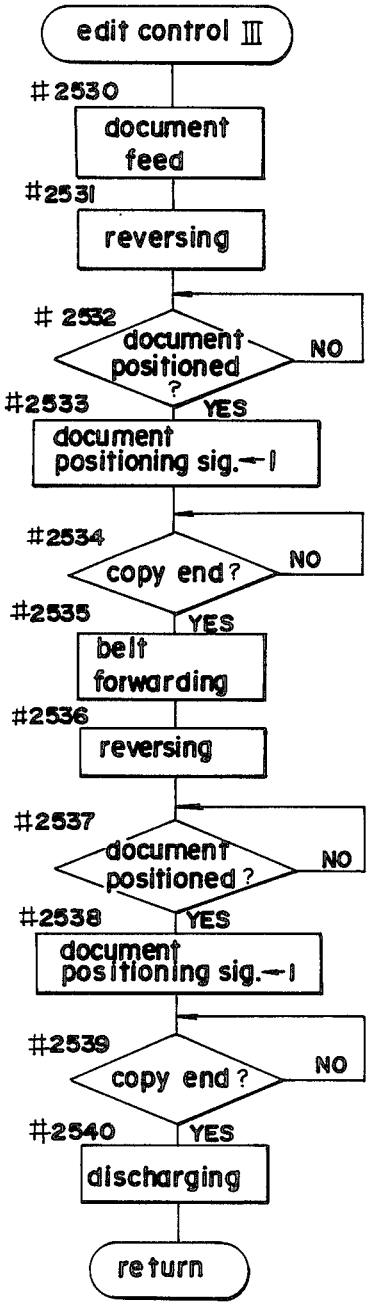

FIGS. 29A to 29C show edition control subroutines for one single-faced original, two single-faced originals and double-faced original, respectively.

In the case of one single-faced original shown in FIG. 29A, the document tray is checked for the presence of orginal thereon in step #2500. If the check result is "YES", the ADF motor M5 and the document feed clutch CL301 are turned on (#2502) on condition that the ADF start signal is "1" (#2501). This signal is changed to "1" by step #504 of FIG. 19.

Next, the clutch CL302 is turned on in step #2503 for the original to enter the reverse assembly 303. The feeder is allowed to stand in this state until the sensor SE7 detects the rear end of the original being transported in step #2504, whereupon an unillustrated clutch is changed over in step #2505 to reverse the direction of travel of ADF document conveyor belt. When the leading end of the original turned upside down by the reverse assembly 303 is detected by the sensor SE7 (#2506), a timer G is set in step #2507. On completion of operation of the timer G, the motor M5 is turned off (#2508, #2509). The timer G is set to the time taken for the leading end of the original to travel in the reverse direction to the exposure start position after actuating the sensor SE7.

By the process described above, the original set in position face up is reversed, transported on the glass plate 16 and then stopped with its leading end located at the exposure start position. In step #2510, the document home position signal is changed to "1", indicating that the original is ready for copying. This signal is detected in step #507 of FIG. 19. Start of copying operation then follows.

Step #2511 checks whether the copying operation for the set original has been completed. Next step #2512 checks whether there are other copying modes set for edition copying. Since the subroutine shown in FIG. 29A is intended for one single-faced original, the other copying modes as herein mentioned are for copying two areas of a single-faced original which are stored as A original and B original, including a case wherein the two areas are copied separately to obtain two single-faced copies, a case wherein the areas are copied to obtain a double-faced copy, and a case wherein the areas are copied as shifted to obtain a single-faced composite copy. If there is such a mode of edition copying, the sequence returns from step #2512 to step #2510, in which the document home position signal is changed to "1" again to start edition copying in this mode.

When step #2512 detects that the entire copying operation has been completed, the direction of travel of the belt is changed again to the forward direction (#2513), the motor M5 is turned on (#2514), the clutch CL302 is turned off (#2515), the same timer F as mentioned with reference to FIG. 28 is set (#2516), and the motor M5 is turned off on completion of operation of the timer F (#2517, #2518). The main routine is then resumed.

FIG. 29B shows the edition control subroutine for two single-faced originals. In this routine, step #2520 marked with "document feed" is identical with the process of steps #2500 to #2502 in FIG. 29A. Steps #2521, #2522 marked with "reversing", "document positioned?" are similarly identical with steps #2503 to #2509, whereby the original set face up is placed on the glass plate 16 face down. The document home position signal is changed to "1" in step #2523. When the copying operation for the original is completed (#2524), the original is discharged (#2525). The discharging step #2525 is identical with steps #2513 to #2518.

Step #2526 checks whether the original has been fed twice. When only one original has been fed, step #2520 follows for the second original.

FIG. 29C shows the edition control subroutine for double-faced original. In this routine, step #2530 reading "document feed" is identical with steps #2500 to #2502 of FIG. 29A. Steps #2531, #2532, and #2536, #2537 reading "reversing", "document positioned?" are identical with steps #2503 to #2509 in FIG. 29A. Step #2540 reading "discharging" is identical with steps #2513 to #2518 in FIG. 29A.

In this subroutine, the first surface of the original set face up is first set on the glass plate 16 in steps #2530 to #2533. On completion of copying in step #2534, the belt is driven in the forward direction in step #2535. In steps #2536 to #2538, the second surface of the original is set on the glass plate 16. When the second surface has been copied (#2539), the original is discharged (#2540).

FIG. 30 shows the main routine for the fourth CPU 204 for controlling the double face unit. The initialization step #3000 is followed by step #3001 in which a routine timer is set, step #3002 in which a subroutine is executed for controlling the operation of the double face unit, and step #3003 in which the routine timer operation is completed. The sequence then returns to step #3001. As is the case with the other CPU's, the fourth CPU conducts communications with the first CPU 201 by interruption.

FIG. 31 shows the operation control subroutine of step #3002.

First, step #3100 checks whether the machine is in the double-faced copy mode. If the check result is "YES", step #3101 checks whether the paper is a front side copy or rear side copy depending on whether the paper is fed via the intermediate tray 253. In the case of a front side copy, the clutches CL100 and CL101 are turned on in steps #3102 and #3103, respectively, whereby the paper from the pair of discharge rollers 29 is led onto the intermediate tray 253. If a rear side copy is detected in step #3101, indicating that the edition copying is completed, the clutch CL100 is turned off to deliver the paper to the sorter 280.

Step #3104 checks whether the machine is in the composite copy mode. In the case of the composite copy mode, the next step #3105 determines whether the copy is from the first copying cycle or the second. If it is from the first cycle, the clutch CL100 is turned on and the clutch CL101 is turned off in steps #3106 and #3107, with the result that the paper is transported without passing over the intermediate tray 253 and is subjected to the second copying cycle on the same side as the first. When the results of steps #3104 and #3105 are "YES", the sequence proceeds to step #3108.

Subsequently, the intermediate tray is checked in step #3109 as to whether the paper has been completely thereby received. On completion, the clutch CL102 is turned on, moving the intermediate tray 253 to the broken-line position of FIG. 1 (#3110). A timer H is set in step #3111. On completion of operation of the timer H (#3112), the clutch CL102 is turned off (#3113), the clutch CL103 is turned on to deliver a drive power to the re-feed roller 254 (#3114), and a timer I is set (#3115). On completion of operation of the timer I, the clutch CL103 is turned off (#3116, #3117).

According to the flow charts described, the copying machine of the present invention having the above features performs edition copying operation in various modes, which will be described below.

Figure 32:
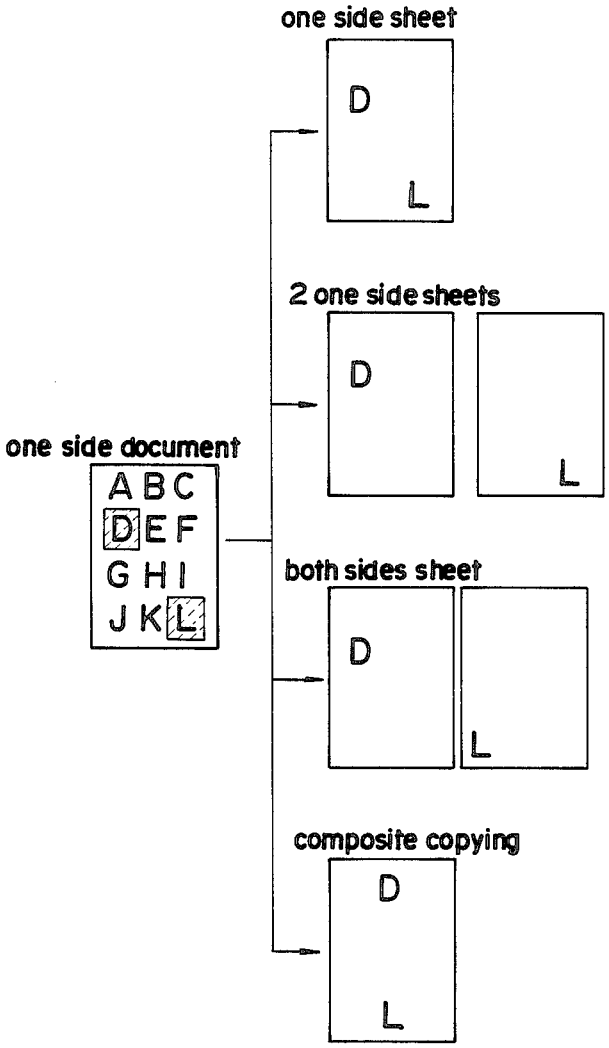
FIGS. 32 to 35 are diagrams schematically showing different edition modes.

FIG. 32 shows edition copies to be prepared from a single-faced original, which has A to L images as arranged downward. Of these, it is assumed that D and L are specified as copy image areas. With the original as well as the copy paper, the left edge shown is its leading end toward the feed direction.

When a single-faced copy is to be made from the original, both D and L images are stored as A originals for specifying the copy image areas, and based on this area specification, the electrostatic latent images for the other A to C and E to K are erased by the inter-image eraser 400. The D and L images only are transferred onto copy paper.

Next, when two single-faced copies (mode) is selected on the second operation panel 360, the two images on the single original are to be copied on two sheets of copy paper, so that D image and L image are separately area-specified. Thus, D image is stored as A original, and L image as B original. These images are reproduced on separate sheets of paper.

To obtain two single-faced copies, the images are copied separately on two sheets of paper, whereas when double-faced copy is selected, the two images on the single original are copied on the front and rear sides of a single sheet of copy paper. Thus, the images on the single original are divided, so that this copy mode will be termed divided copy. In the case of double-faced copy, the areas of original are specified in the same manner as is the case with two single-faced copies, whereas a single sheet of copy paper is fed twice by the double face unit 250. In FIG. 32, L image stored as B original is shifted in the feed direction. Because the copying machine of the embodiment makes a perpendicular shift by shifting the manual feeder 40, it is to be noted that this shift is impossible for the rear side. When a perpendicular shift is to be made for both front and rear side by the present copying machine, the copying cycle for the combination of one single-faced original and one singlefaced copy is repeated again with use of the same sheet of copy paper. It is of course possible to conduct this operation automatically, for example, by rendering the intermediate tray movable in the perpendicular direction by a motor in accordance with an amount of shift given as an input.

Finally a composite copy mode will be described. A composite copy is prepared from the single-faced original by separately specifying the two original image areas and copying these areas on a single sheet of copy paper, with the areas shifted relative to each other thereon. FIG. 32 shows that D image stored as A original is shifted in a direction opposite to the feed direction and also upward, as illustrated,in the perpendicular direction. It is also seen that L image stored as B original is shifted toward the feed direction.

Figure 33:
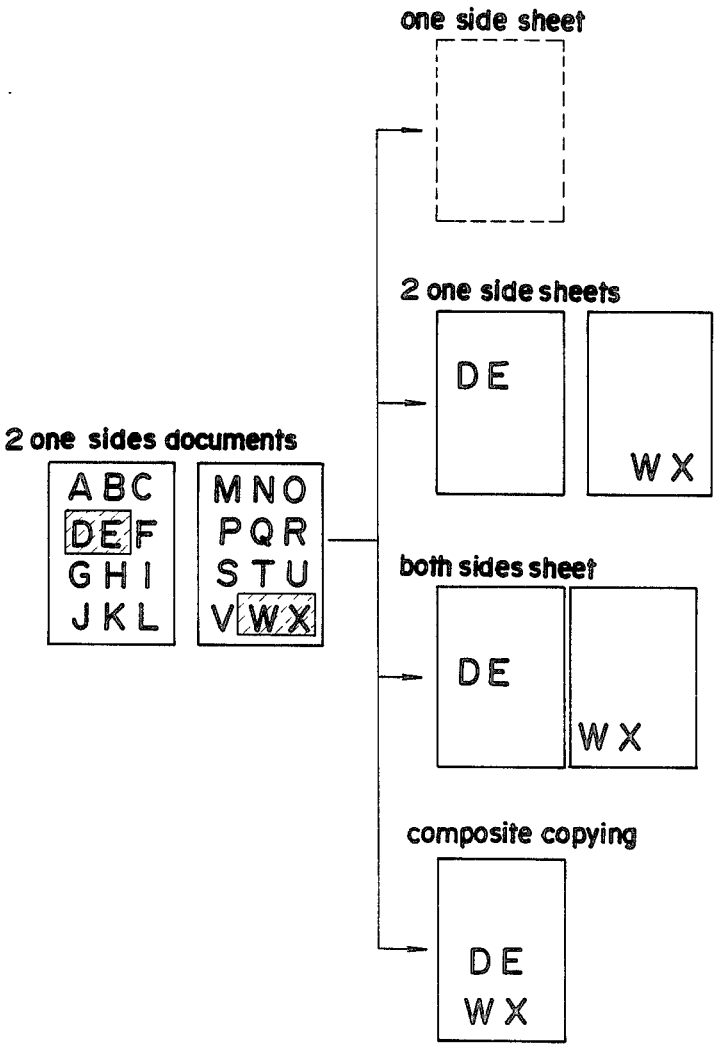
Figure 34:
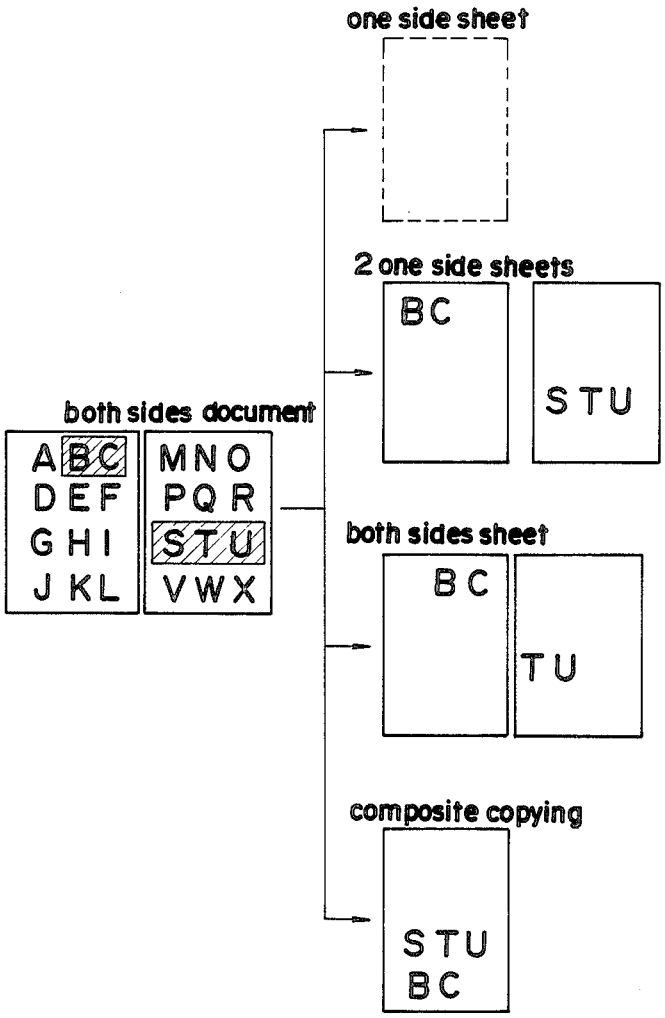
Figure 35:
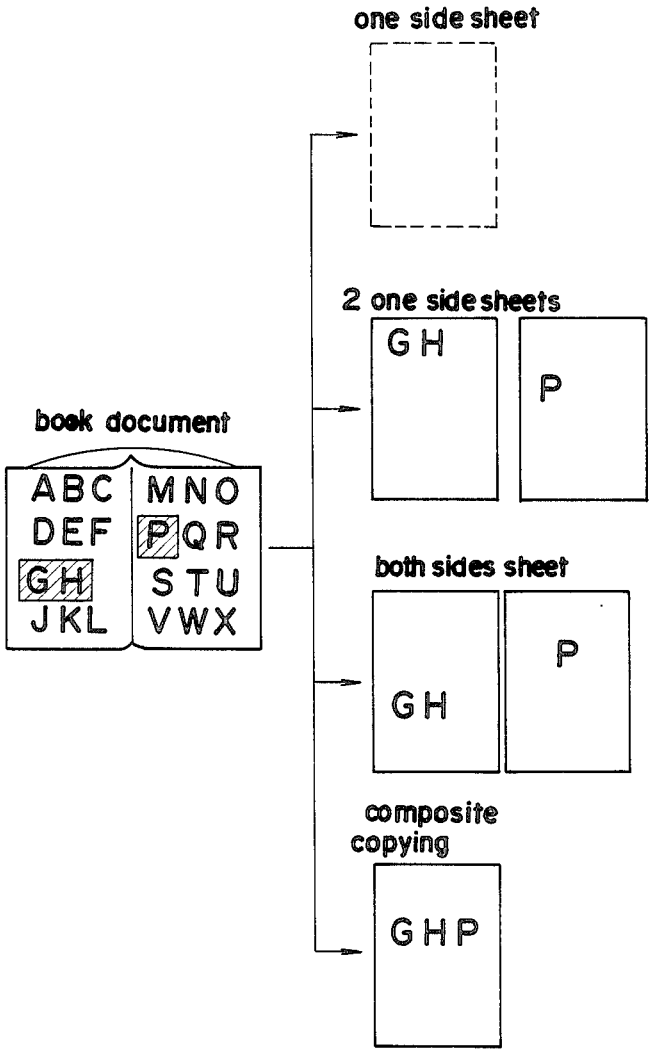

Similarly, FIG. 33 shows various edition copy modes for two single-faced originals, FIG. 34 shows those for a double-faced original, and FIG. 35 shows those for a book original. In these drawings, two original or copy paper portions shown as spaced apart by a large distance represent separate sheets, while such two portions shown as spaced apart by a small distance represent the front side (at left) and the rear side of one sheet. The hatched portions of the original are the selected copy image areas. The copying machine of the present invention is adapted for various modes of edition copying as shown in these drawings. Incidentally, it is to be noted that in FIGS. 33 to 35, there is no combination of the original with one single-faced copy. Further in the case of book originals, the ADF is used only for specifying copy image areas, and the book original is set manually by the user.

Modifications of the present invention will be described next.

According to the embodiment described, the effective copy image area and the specified copy image area are displayed in block units. The effective area is calculated from the paper size and the magnification. Depending on these parameters, the calculated area size is not always in agreement with block units, while according to the embodiment, an area made up of the largest number of blocks within the calculated area size is used as the effective area, in view of the resolving power which is dependent on the number of light-emitting elements constituting the inter-image eraser 400. When an increased number of light-emitting elements are used for giving an improved resolving power, it is possible to show an effective copy image area without being limted by block units as seen in FIG. 36 and to conduct edition accordingly.

Display of effective copy image areas independent of block units is well-suited to electrophotographic copying machines in which the magnification is variable substantially steplessly, such as the one disclosed in U.S. patent application Ser. No. 498,885 filed on May 27, 1983.

Figure 36:
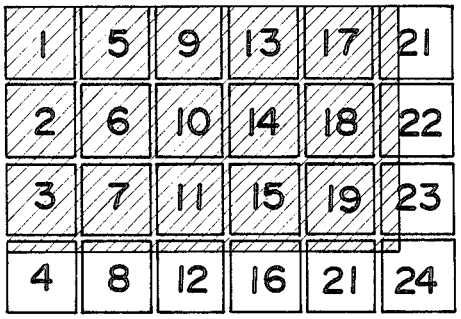
FIGS. 36 and 37 are diagrams showing the graphic display of a first modification in operation.
Figure 37:
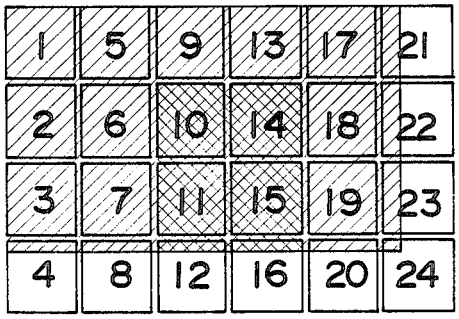

When the effective copy image area is to be displayed as shown in FIG. 36, the blocks which are covered by the effective area only partly need also be specified. With reference to FIG. 37, for example, the blocks 12 and 16 need to be specified. Whereas in step #2105 of FIG. 23, the effective copy image area calculated in step #2104 is expressed in blocks, such a display can be realized by feeding the calaculated effective area to the graphic controller as it is, in place of the above step. The unit of calculation is of course dependent on the resolving power of the inter-image eraser 400. For the display of the specified area of FIG. 37, the judgment of steps #2109 and #2113 in FIG. 23 is so made as to also include the block numbers which lap over the effective area only partially. As to the overlapping block numbers included in the block numbers sent to the graphic controller in step #2126, the controller is so adapted as to show only the portions which overlap the effective area.

According to a second modification, the graphic display mounted on the first operation panel 330 is provided on the operation panel 70 of the copying machine.

Figure 38A:
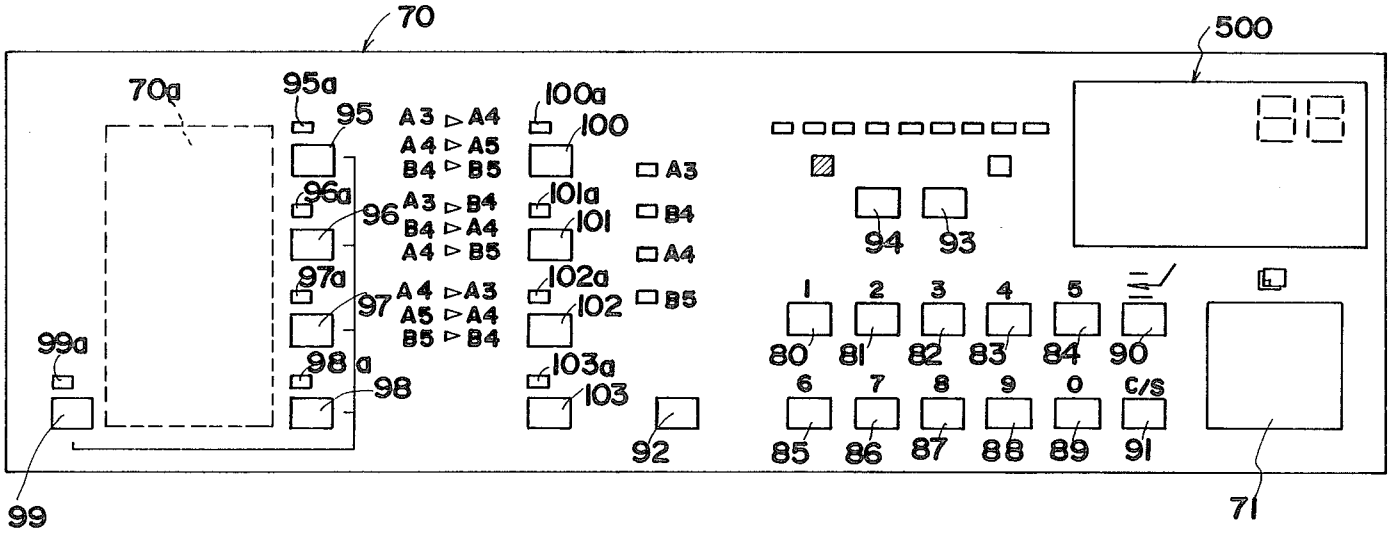
FIGS. 38A, 38B and 39 are diagrams showing a copying machine control panel and the construction of control system of copying machine according to a second modification.

As seen in FIG. 38A, the seven-segment display of the operation panel 70 is afforded by a graphic display 500 which serves as a seven-segment display portion for showing the number of copies, magnification, etc. and which also shows document edition blocks and gives copy edition displays such as those shown in FIGS. 7C to 7F. In this case, the control circuit of the first CPU 201 includes a graphic controller 501 for controlling the graphic display 500. Of course, edition copy display data is delivered from the third CPU 203.

Figure 40:
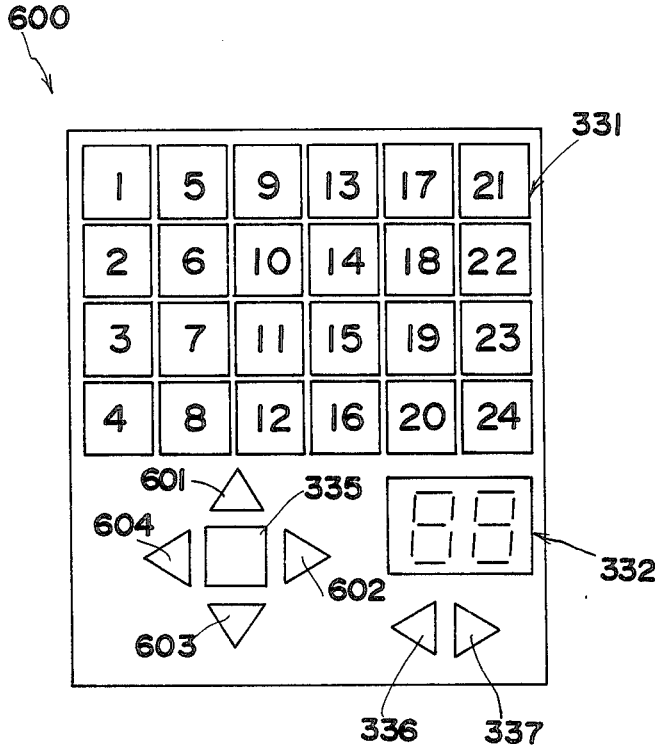
FIG. 40 is a plan view showing a first panel of a third modification.

A third modification relates to the specification of block numbers by the first operation panel. FIG. 40 shows a first operation panel 600. According to the foregoing embodiment, the block number is incrementally or decrementally changed, whereas this modification has four keys 601, 602, 603 and 604 for shifting the block upward, downward, leftward and rightward. Using these keys, the block number shown on the number display 332 is changed and the number is specified as a portion of the specified area. To realize this, steps #2106 to #2123 of FIG. 23 are replaced by the sequence shown in FIG. 41.

Figure 41:
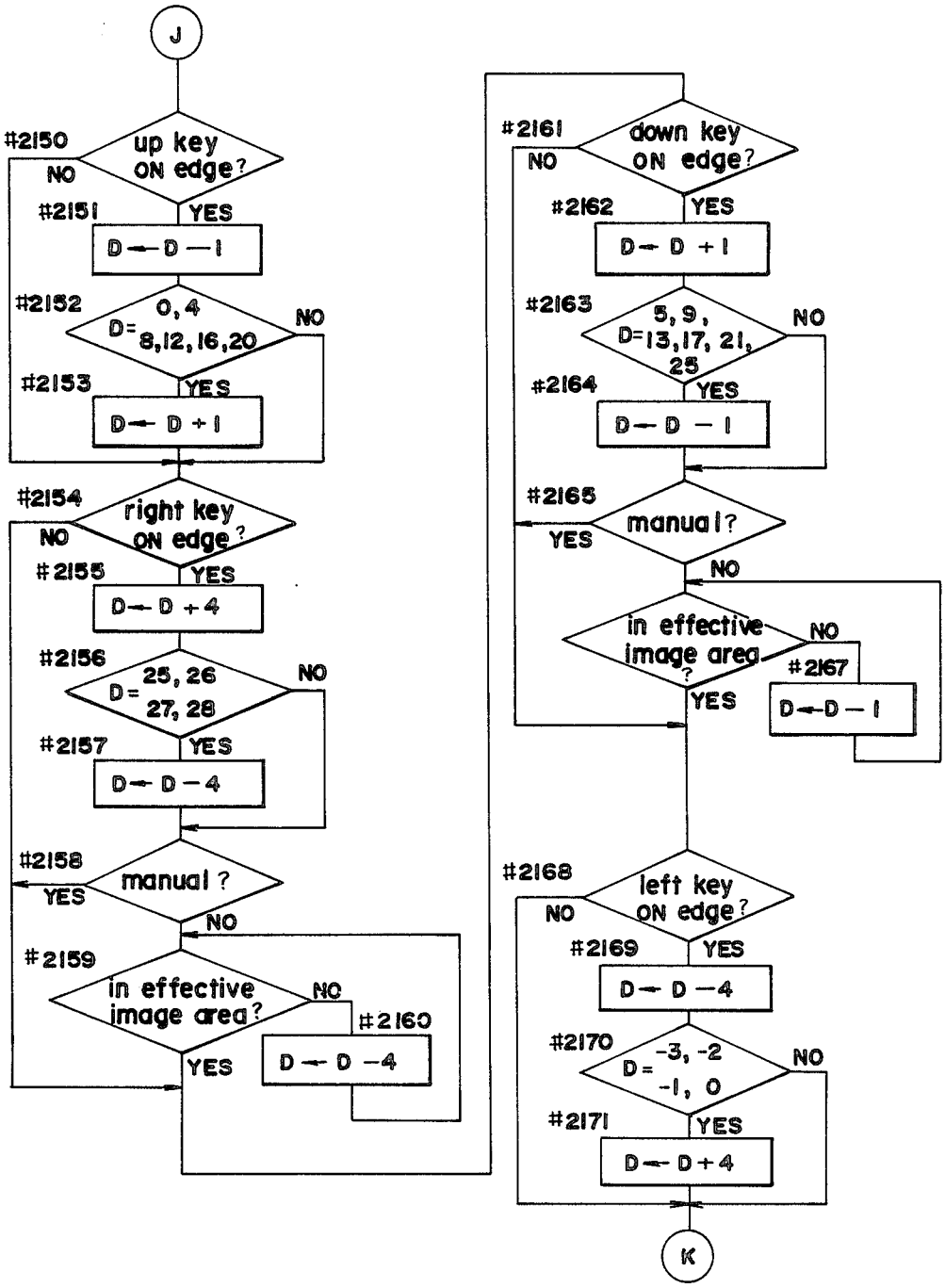
FIG. 41 is a flow chart as a substitute for a portion of FIG. 23 for the modification.

With reference to the flow chart of FIG. 41, steps #2150 to #2153 are for the up shift key 601, steps #2154 to #2160 are for the right shift key 602, steps #2161 to #2167 are for the down shift key 603, and steps #2168 to #2171 are for the left shift key 604.

Upon depression of the up shift key 601, "1" is first subtracted from the data in a block number setting register D (#2150, #2151). The register D is first set to "1" by the initialization of the main routine of the third CPU. Steps #2152 and #2153 detect that the data in the register become 0, 4, 8, 12, 16, 20, whereupon "1" is added to the register to resume the initial block numbers because the block numbers before step #2151 were 1, 5, 9, 13, 17, 21, indicating the upper limit of the shift.

Next, when the right shift key 602 on edge is detected, "4" is added to a register D in step #2155. Steps #2156 and #2157 prevent the block numbers from shifting rightward beyond the right edge of the display.

Step #2158 determines whether the current mode is the manual feed mode or cassette mode. In the case of the manual feed mode in which the paper size is not known, no effective copy image area is set. The sequence therefore proceeds to steps #2162 et seq. for the down shift key. In the case of the cassette mode, the block numbers are prevented from shifting out of the effective copy image area by steps #2159 to #2160. Thus, "4" is subtracted from the data in the register D (shifting the blocks leftward) to render the right shift key 602 operable only within the effective copy image area.

With the copying machine of the present invention, the sheets of paper to be fed are in register at one side, so that the effective copy image area is unchanged at its upper edge and left edge and changes only at the lower edge and right edge as seen in FIG. 24A. Accordingly, the blocks will not be shifted out of the effective area by the up shift key and the left shift key. It therefore follows that the judgment as to the manual feed mode, judgment as to whether the blocks are within the effective area and the steps concerned are provided only for the right shift key and the down shift key.

Steps #2161 to #2167 for the down shift key include steps #2162 to #2164 which are in reverse relation to those for the up shift key. Steps #2165 to #2167 are provided for limiting the foregoing shiftable range to within the effective copy image area.

Steps #2168 to #2171 for the left shift key are in reverse relation to steps #2154 to #2157 for the right shift key.

Of the keys included in the switch matrix of FIG. 11, the keys 333 and 334 are of course replaced by the keys 601, 602, 603, 604 for the above modification.

Figure 42:
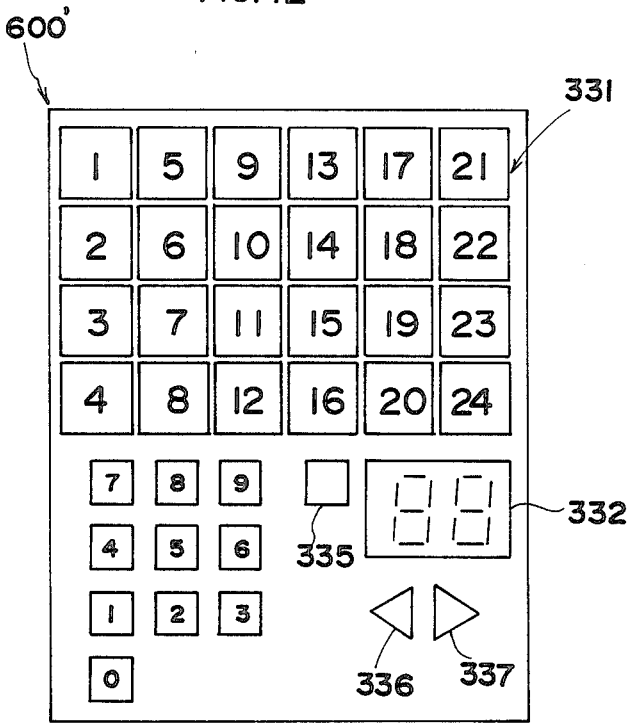
FIG. 42 is a plan view showing a first operation panel for a fourth modification.

A fourth modification is adpated to specify copy image blocks using ten numerical keys. FIG. 42 shows a first operation panel 600′ provided with such a ten-key arrangement. Input control in this case may be done in the same manner as when the usual copy number setting ten-key arrangement is manipulated and therefore will not be described. Since the panel shown in FIG. 42 has no clearing key, the display is so adapted that the input numerical value is shown in the units position, with the preceding value in the units position shifted to the tens position. The area specified in the case of cassette mode can be limited to within the effective copy image area by such a procedure that if the block number on display when the setting key is depressed is outside the effective area, the number is not accepted, with no black display on the block display portion 331. The display of "00" may be given or the number display portion may be made to flicker to notify the user of such a situation.

The numerical ten-key arrangement on the operation panel of the copying machine may be used for specifying block numbers. In this case, the first operation panel is the one shown in FIG. 42 from which the ten-key arrangement is omitted. Further in this case, the input by the ten-key arrangement on the copying machine is transferred to the third CPU only while the document edition mode is selected by the edition selection key to use the input for the display of block number, while the displays of copy number, etc. are allowed to remain unchanged.

Figure 38B:
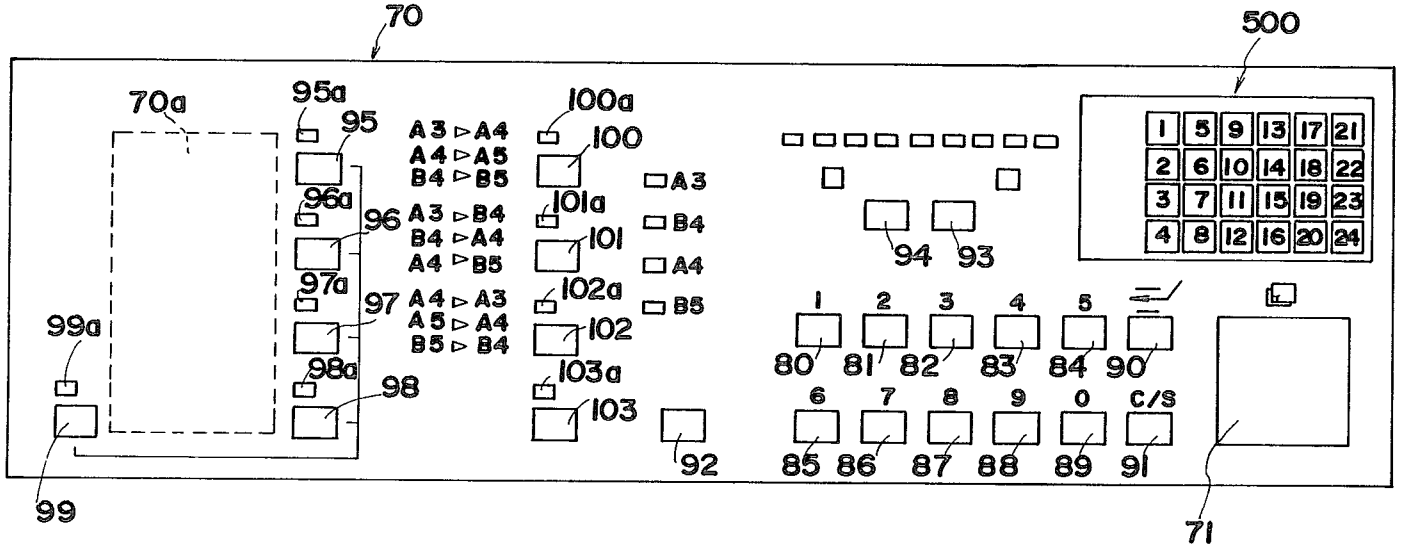
Figure 43:
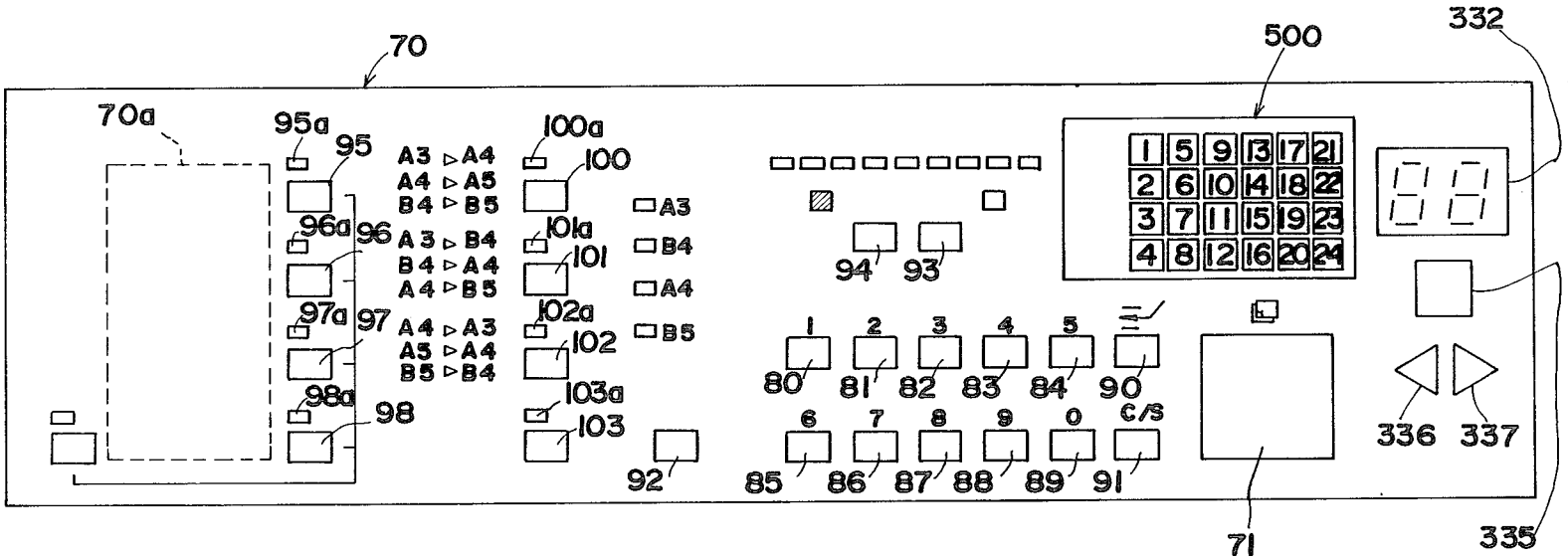
FIG. 43 is a plan view showing a copying machine operation panel according to a fifth modification.

When the ten-key arrangement on the operation panel of the copying machine is used, a graphic display 500 may be provided on the copying machine operation panel as seen in FIG. 38B. This assures greater convenience. FIG. 43 shows such a modification, in which the number display 332, setting key 335, left and right shift keys 336, 337 on the first panel are also mounted on the operation panel of the copying machine.

Figure 44:
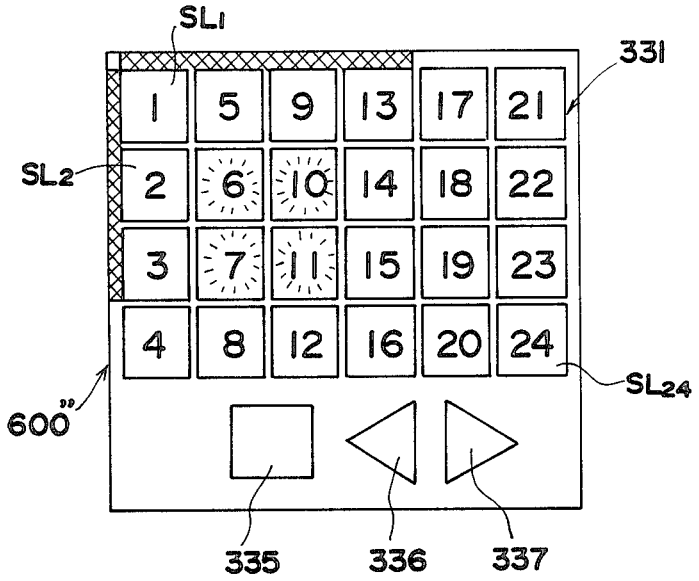
FIG. 44 is a plan view showing a first panel according to a sixth modification.

FIG. 44 shows a sixth modification of first operation panel 600″. The blocks comprise self-illuminating switches SL1 to SL24. The self-illuminating switch has a pressing surface which, when pressed on, emits light. According to the embodiments described, the setting key 335 is depressed for each block for specifying an edition area, whereas with the panel shown in FIG. 44, an area can be specified by depressing the setting key 335 after all the self-illuminating switches in the specified area are turned on. Because self-illuminating switches are unable to provide two kinds of displays, the line indicators shown in FIG. 24B may be used for showing the effective copy image area. The line indicator can be an array of minute LED's.

Figure 45:
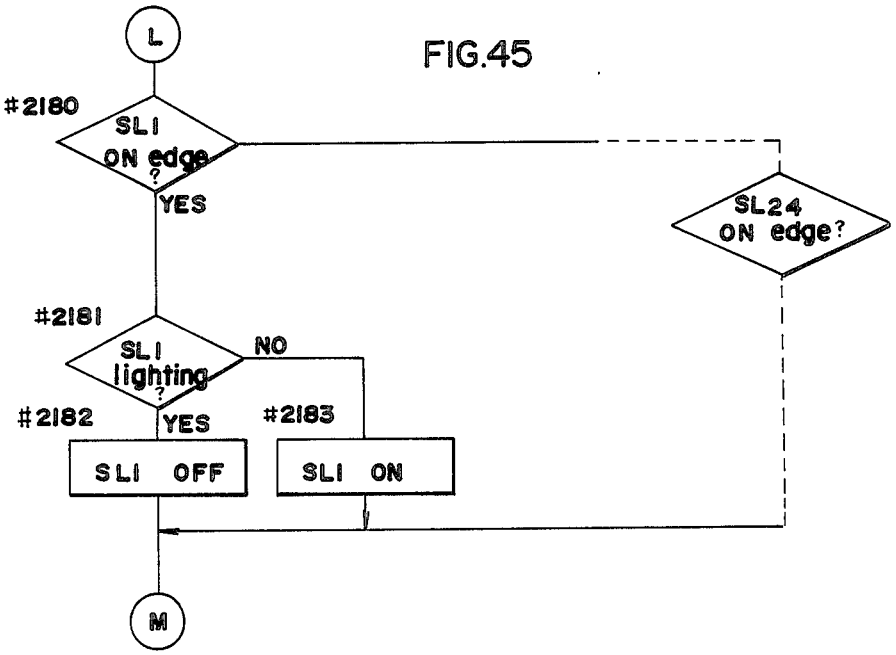
FIG. 45 is a flow chart as a substitute for a portion of FIG. 23 for the same modification.

FIG. 45 shows part of a control flow chart for the self-illuminating switches SL1 to SL24, which substitutes for steps #2106 to #2124 of FIG. 23.

Although FIG. 45 shows a sequence for the switch SL1 only, the other switches which are not shown are controlled by exactly the same sequence. Step #2180 detects the switch on edge. If the check result is "NO", a similar check follows for the next switch. If the result is "YES", step #2181 checks whether the switch is on. When on, the switch is turned off (#2182), whereas if off, the switch is turned on (#2183). When step #2125 in FIG. 23 detects the depression of the setting key 335, the block number of the switch turned on is stored in the memory in the next step #2127. In the case of the self-illuminating switch, step #2126 in FIG. 23 is omitted. FIG. 45 does not show the step for limiting the specified area to within the effective copy image area. This can be realized by the additional steps of checking whether the self-illuminating switch turned on, i.e., the block number thereof, is within the effective area and holding the switch off if the result is negative.

Another modification relates to perpendicular shift for copy edition. The embodiment already described employs the method of shifting the manual feeder in the perpendicular direction, detecting the amount of the shift by the pulse disk 43 and the photosensor 44 and shifting frame lines representing copy paper on the copy edition display on the graphic display portion 331 to show the position of the specified area relative to the paper. This method readily indicates the position of the paper and the specified area relative to each other, but the manual feeder is positioned usually away from the graphic display portion, so that the arrangement is difficult to use.

Figure 39:
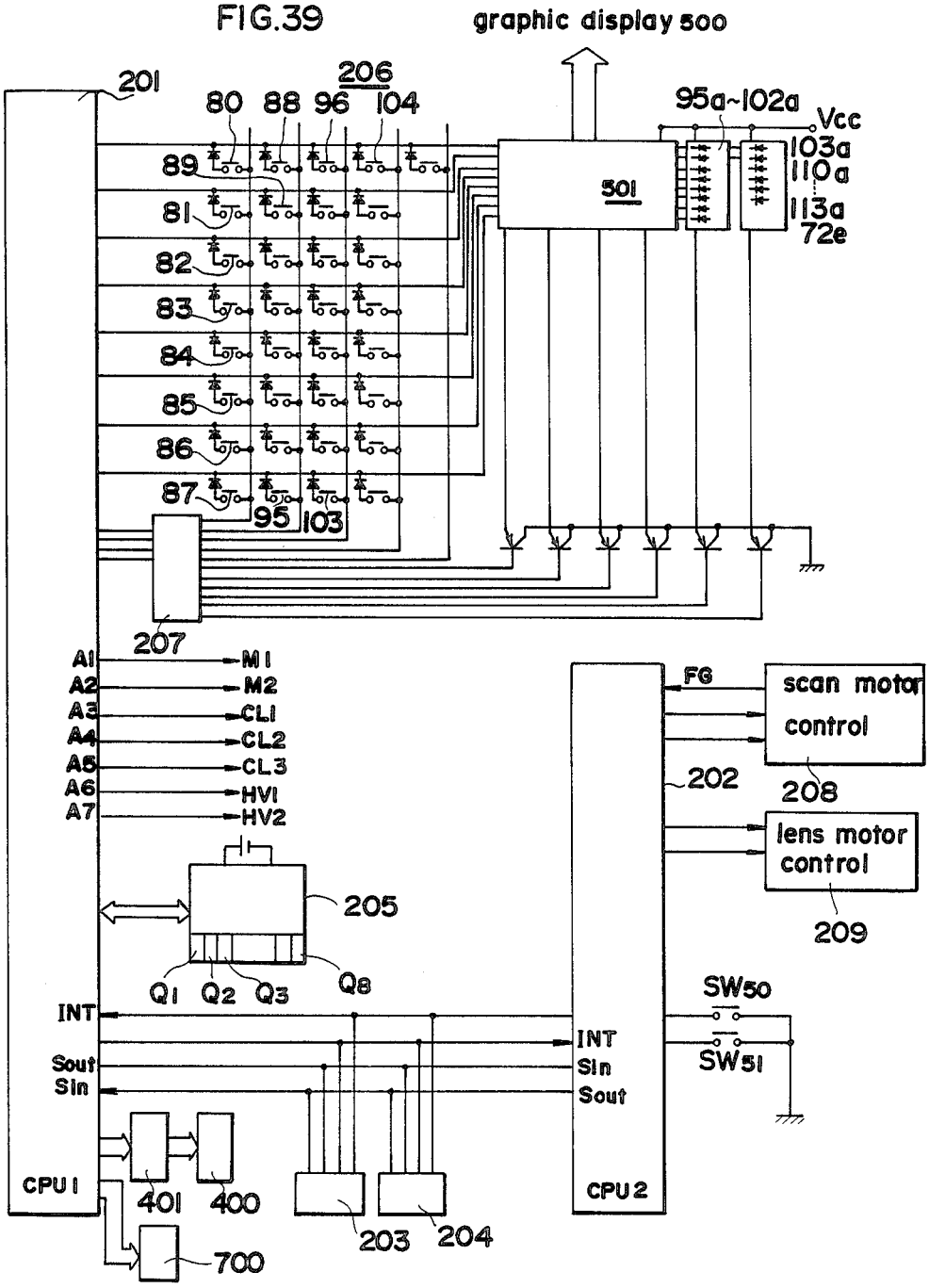
Figure 46A:
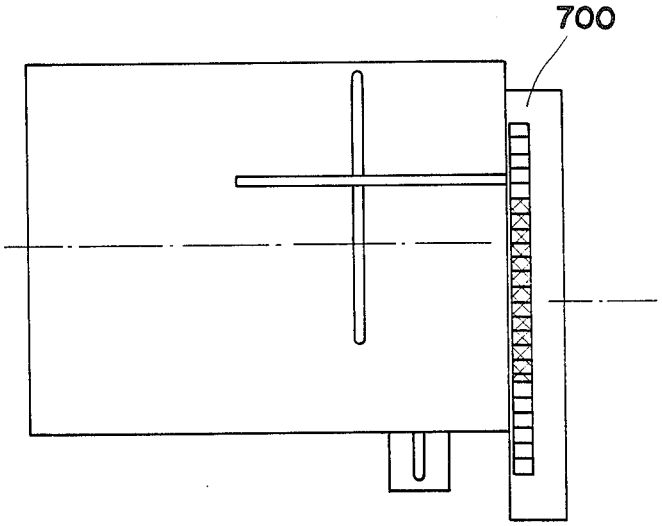
FIGS. 46A, 46B are plan views showing a manual paper feeder according to a seventh modification.
Figure 46B:
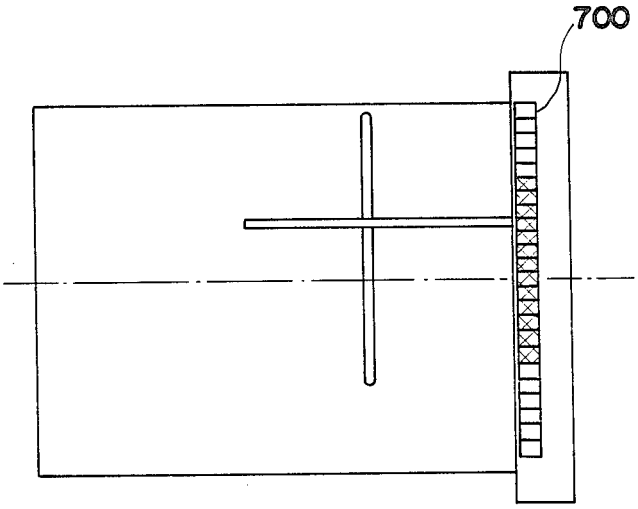
Figure 47:
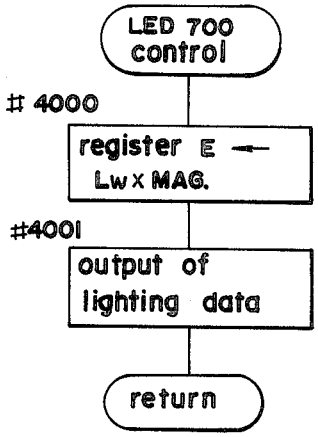
FIG. 47 is an additional flow chart for the same modification.

FIG. 46 shows an indicator disposed in the vicinity of the manual feeder for indicating the width in the perpendicular direction of the specified area. More specifically, an LED array 700 is provided on the main body close to the manual feeder, and the array 700 indicates the width of the specified area. Since the LED array is mounted on the copying machine main body, it is controlled for flickering by the first CPU 201 as seen in FIG. 39. For this control, the subroutine shown in FIG. 47 is added to the main routine for the first CPU. In step #4000 in FIG. 47, a value obtained by multiplying the width of the specified copy image area by the magnification is set in the register E, and the value is given as L data for turning on the LED array 700 (#4001).

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying apparatus capable of copying a partial image of a document, the apparatus comprising:
- a document platen on which the document is positioned for copying;
- a document handling device having a tray on which the document can be placed in a face-up condition, a transparent plate with a grid pattern and block numbers assigned to each block in the grid pattern, a document transporting portion for transporting and positioning the document on the document platen and a document inverting portion for turning the document upside down, the document handling device being controlled so that the document placed on the tray in a face-up condition is transported as it is and then positioned on the document platen after inversion by the document inverting portion;
- means for forming a latent image of the document on a photosensitive member;
- means for partly irradiating the latent image with light;
- means for developing the latent image into a toner image;
- means for providing copy paper so as to receive the toner image thereon;
- means for selecting a desired copy area on the document by indicating a block number with use of the transparent plate, and
- means for controling the irradiating means in accordance with the selecting means.

2. A copying apparatus as claimed in claim 1, wherein the selecting means includes a ten-key device for inputting the block number and a set key for setting the inputted block number as the desired copy area.

3. A copying apparatus as claimed in claim 1, wherein the selecting means includes a selection device for selecting the desired area by indicating the block number, a display device having a recognizable indicia for each of the blocks and displaying a specified area to be set in accordance with the selection device and a set key for setting the specified area as the desired area.

4. A copying apparatus as claimed in claim 3, wherein the selection device includes a ten-key device.

5. A copying apparatus as claimed in claim 3, wherein the selecting device includes shift keys for shifting a recognizable indication of a certain block number to another block number.

6. A copying apparatus as claimed in claim 5, wherein the shift keys include an up key for increment of an indicated block number and a down key for decrement thereof.

7. A copying apparatus as claimed in claim 1, wherein the irradiating means includes a plurality of light emitting elements aligned in a direction normal to the moving direction of the photosensitive member, and each of the light emitting elements can be independently turned on or off.

8. A copying apparatus as claimed in claim 1, wherein the copy paper providing means includes a circulation path in which copypaper, previously copied on one face thereof, is fed again to an image transfer station so as to receive the toner image on the same face.

9. A copying apparatus as claimed in claim 1, wherein the copy paper providing means includes a circulation path having a paper inversion portion in which copy paper, previously copied on one face thereof, is fed again to an image transfer station so as to receive the toner image on another face of the copy paper.

10. A copying apparatus as claimed in claim 1, wherein the selecting means includes an input device for inputting a plurality of block number individually to indicate the desired copy area of an arbitrary form.

11. A copying apparatus as claimed in claim 1, wherein the document handling device further includes means for transporting the document in a direction parallel to a direction of the copy paper transportation.

12. A copying apparatus capable of copying a partial image of a document, the apparatus comprising:
- a document platen on which the document is positioned for copying;
- means for selecting a desired copy area on the document;
- means for forming a latent image of the document on a photosensitive member, the image forming means including a magnification changing mechanism;
- means for partly irradiating the latent image with light;
- means for developing the latent image into a toner image;

means for handling copy paper so as to receive the toner image thereon, the copy paper handling means includes a plurality of paper feeding sections which stock papers with different sizes respectively, and means for controlling the irradiating means so as to erase any unnecessary area other than the desired copy area in accordance with the selecting means and for controlling the paper handling means so as to select one paper feeding section which stocks papers of adequate size for the desired copy area.

13. A copying apparatus as claimed in claim 12, wherein the irradiating means includes a plurality of light emitting elements aligned in a direction normal to the moving direction of the photosensitive member and capable of being turned on or off independently from each other.

14. A copying apparatus as claimed in claim 12, wherein the desired copy area can be selected as a set of plural blocks which have a predetermined size and numeral indicia, respectively, and the selecting means includes an input device for inputting a number corresponding to the numeral indicia for each of the blocks constituting the desired copy area.

15. A copying apparatus capable of copying a partial image of a document, the apparatus comprising:

a document platen on which the document is positioned for copying;

means for selecting a desired copy area on the document;

means for forming a latent image of the document on a photosensitive member, the image forming means including a magnification changing mechanism;

means for irradiating at least a portion of the latent image with light;

means for developing the latent image into a toner image;

means for handling copy paper so as to receive the toner image thereon;

means for calculating a magnification value from a size of the desired copy area selected by the selecting means and a size of the copy paper in use, and means for controlling the magnification changing mechanism so as to automatically set the calculated magnification value and for controlling the irradiating means to erase any unnecessary area in accordance with the selecting means and the calculating means.

16. A copying apparatus as claimed in claim 15, wherein the irradiating means includes a plurality of light emitting elements aligned in a direction normal to the moving direction of the photosensitive member and capable of being turned on or off independently from each other.

17. A copying apparatus as claimed in claim 15, wherein the calculating means calculates a first magnification value from longitudinal lengths of the desired copy area and the copy paper and a second magnification value from lateral lengths of the desired copy area and the copy paper, and then determines the smaller of the first and second values as the value to be used.

18. A copying apparatus as claimed in claim 15, wherein the desired copy area can be selected as a set of plural blocks which have a predetermined size and numeral indicia, respectively, and the selecting means includes an input device for inputting a number corresponding to the numeral indicia for each of the blocks constituting the desired copy area.

19. A copying apparatus capable of copying a partial image of a document, the apparatus comprising:

a document platen on which the document is positioned for copying;

means for selecting a desired copy area on the document;

means for forming a latent image of the document on a photosensitive member;

means for irradiating at least a portion of the latent image with light in accordance with the selection of the desired copy area;

means for developing the latent image into a toner image;

means for handling a copy paper so as to receive the toner image thereon;

means for inputting a position of the copy area to be formed on the copy paper;

means for altering a position of the copy paper at least in the direction perpendicular to the copy paper feeding direction in accordance with the inputting means, and means for controlling the irradiating means so as to erase any unnecessary area other than the desired copy area in accordance with the selecting means.

20. A copying apparatus as claimed in claim 19, further comprising a display means for displaying the position of the copy area and the size of the copy paper to be used.

21. A copying apparatus as claimed in claim 19, wherein the altering means includes a manual paper feed table which is shiftable in a direction perpendicular to the paper feed direction and from which a copy paper is fed to the copy paper handling means.

22. A copying apparatus capable of copying a partial image of a document, the apparatus comprising:

a document platen on which the document is positioned for copying;

means for selecting a desired copy area on the document;

means for forming a latent image of the document on a photosensitive member;

means for irradiating at least a portion of the latent image with light in accordance with the selection of the desired copy area;

means for developing the latent image into a toner image;

means for handling a copy paper so as to receive the toner image thereon, the copy handling means includng a circulation path in which copy paper, previously copied on one face thereof, is fed again to an image transfer station so as to receive the toner image on the same face;

means for storing two groups of data of a desired copy area selected by the selecting means, and means for controlling the irradiating means and the copy paper handling menas so as to erase any unnecessary area of a first face of the copy paper and a second face thereof in accordance with the storing means.

23. A copying apparatus as claimed in claim 22, wherein the selecting means includes a selection device for selecting the desired area by indicating block numbers, a display device having recognizable indicia for each of the blocks and displaying a specified area to be set in accordance with the selection device and a set key for setting the specified area as the desired area into the storing means.

24. A copying apparatus as claimed in claim 22, wherein the selecting means includes an input device for inputting a plurality of block numbers individually to indicate the desired copy area of an arbitrary form.

25. A copying apparatus as claimed in claim 23, wherein the selection device includes a ten-key device.

26. A copying apparatus capable of copying a partial image of a document, the apparatus comprising:

a document platen on which the document is positioned for copying;

means for selecting a desired copy area on the document;

means for forming a latent image of the document on a photosensitive member;

means for irradiating at least a portion of the latent image with light in accordance with the selection of the desired copy area;

means for devloping the latent image into a toner image;

means for handling copy paper so as to receive the toner image thereon, the copy handling means including a circulation path in which copy paper, previously copied on one face thereof, is fed again to an image transfer station so as to receive the toner image on another face;

means for storing data of the desired copy area selected by the selecting means, and means for controlling the irradiating means and the copy paper handling means so as to erase any unnecessary area on a first face of the copy paper and on a second face thereof in accordance with the storing means.

27. A copying apparatus as claimed in claim 26, wherein the selecting means includes a selection device for selecting the desired area by indicating block numbers, a display device having recognizable indicia for each of the blocks and displaying a specified area to be set in accordance with the selection device and a set key for setting the specified area as the desired area into the storing means.

28. A copying apparatus as claimed in claim 26, wherein the selecting means includes an input device for inputting a plurality of block numbers individually to indicate the desired copy area of an arbitrary form.

29. A copying apparatus as claimed in claim 27 wherein the selection device includes a ten-key device.

30. A copying apparatus capable of copying a partial image of a document, the apparatus comprising:

a document platen on which the document is positioned for copying;

means for selecting a desired copy area on the document;

means for forming a latent image of the document on a photosensitive member;

means for irradiating at least a portion of the latent image with light in accordance with the selection of the desired copy area;

means for developing the latent image into a toner image;

means for handling a copy paper so as to receive the toner image thereon;

means for inputting a position of the copy area to be formed on the copy paper;

a manual paper feed table which is shiftable in a direction perpendicular to the paper feed direction and from which a copy paper is fed to the copy paper handling means, and means for controlling the irradiating means so as to erase any unnecessary area other than the desired copy area in accordance with the selecting means.

31. A copying apparatus as claimed in claim 30, further comprising a display means for displaying the position of the copy area and the size of the copy paper to be used.

32. A copying apparatus capable of copying a partial image of a document, the apparatus comprising:

a document platen on which the document is positioned for copying;

means for forming a latent image of the document on a photosensitive member;

means for partially irradiating the latent image with light;

means for developing the latent image into a toner image;

means for transporting a copy paper so as to receive the toner image thereon;

a document handling device having a tray on which the document can be placed in a face-up condition, a document transporting portion for transporting and positioning the document on the document platen in which the document transporting direction is parallel to the paper transporting direction and a document inverting portion for turning the document upside down;

means for selecting a desired copy area on the document when the document is placed on a tray in a face-up condition and for controlling the irradiating means so as to erase any unnecessary area other than the desired copy area, and means for controlling the document handling device, when the document is placed on the tray in the face-up condition, so that the document is transported as it is and then positioned on the document platen after inversion by the document inverting portion.

33. A copying apparatus as claimed in claim 32, wherein the controlling means controls the document handling device so that the document is positioned on the document platen without invention by the inverting means when the document is placed on the tray in a face-down condition.

* * * * *